US007412735B2

(12) United States Patent
McDaniel et al.

(10) Patent No.: US 7,412,735 B2
(45) Date of Patent: Aug. 19, 2008

(54) PATIENT SUPPORT APPARATUS

(75) Inventors: Richard L. McDaniel, Constatine, MI (US); Jeffrey C. Shiery, East LeRoy, MI (US); Kevin Patmore, Kalamazoo, MI (US); William D. Childs, Plainwell, MI (US); Michael J. Petrowski, Sheboygan, WI (US)

(73) Assignee: Stryker Corporation, Kalamazoo, MI (US)

( * ) Notice: Subject to any disclaimer, the term of this patent is extended or adjusted under 35 U.S.C. 154(b) by 547 days.

(21) Appl. No.: 11/211,065

(22) Filed: Aug. 24, 2005

(65) Prior Publication Data

US 2006/0031991 A1 Feb. 16, 2006

Related U.S. Application Data

(63) Continuation-in-part of application No. 10/917,244, filed on Aug. 11, 2004, now Pat. No. 7,124,456.

(51) Int. Cl.
*A61G 7/012* (2006.01)
*A61G 7/005* (2006.01)

(52) U.S. Cl. ..... 5/611; 5/617; 5/618; 5/614

(58) Field of Classification Search ..... 5/11, 5/611, 614, 617, 618
See application file for complete search history.

(56) References Cited

U.S. PATENT DOCUMENTS 2,682,913 A 7/1954 Scheide
3,237,212 A 3/1966 Hillenbrand et al.
3,304,116 A 2/1967 Stryker
3,353,193 A 11/1967 Greiner
4,048,681 A 9/1977 Baulch et al.
4,222,131 A * 9/1980 Holdt et al. ..... 5/617
4,691,397 A 9/1987 Netzer
4,945,582 A * 8/1990 Hayton et al. ..... 5/610

(Continued)

FOREIGN PATENT DOCUMENTS

EP 0123474 A2 10/1984

OTHER PUBLICATIONS

The commonly owned, co-pending U.S. Appl. No. 11/388,459, filed on Mar. 24, 2006, by Applicants Richard L. McDaniel et al., entitled Articulated Surface for a Stretcher or Gurney.

(Continued)

*Primary Examiner*—Michael Trettel
(74) *Attorney, Agent, or Firm*—Van Dyke, Gardner, Linn, Burkhart, LLP

(57) ABSTRACT

A patient support apparatus includes a base, a litter frame, and an elevation mechanism interconnecting the base to the litter frame and being configured to effect changes in elevation of the litter frame relative to the base. The elevation mechanism includes a pair of hydraulic actuators, each actuator covered by a telescoping shroud. The telescoping shroud is connected to the base and to the litter frame by a number of biased catches. The litter frame includes a pair of laterally spaced and longitudinally extending support rails and a plurality of laterally extending support rails interconnecting the longitudinally extending support rails so that the litter frame has a rectangular configuration. The litter frame includes a thigh section configured to be raised and lowered by use of one of a manually pumped hydraulic actuator or a gas-spring assisted lever actuator.

17 Claims, 38 Drawing Sheets

U.S. PATENT DOCUMENTS

| | | | | | |
|---|---|---|---|---|---|
| 5,343,581 | A | | 9/1994 | Bartley et al. | |
| 5,402,544 | A | | 4/1995 | Crawford et al. | |
| 5,423,097 | A | | 6/1995 | Brule et al. | |
| 5,435,023 | A | | 7/1995 | Wagner et al. | |
| RE35,201 | E | | 4/1996 | Krauska | |
| 5,575,026 | A | * | 11/1996 | Way et al. | 5/617 |
| 5,584,082 | A | | 12/1996 | Crawford et al. | |
| 5,699,567 | A | * | 12/1997 | Sanders et al. | 5/614 |
| 5,924,658 | A | | 7/1999 | Shiery et al. | |
| 5,996,150 | A | | 12/1999 | Blevins et al. | |
| 5,996,151 | A | | 12/1999 | Bartow et al. | |
| 6,226,816 | B1 | * | 5/2001 | Webster et al. | 5/618 |
| 6,253,397 | B1 | | 7/2001 | Bartow et al. | |
| 6,367,427 | B1 | | 4/2002 | Canady | |
| 6,505,364 | B2 | * | 1/2003 | Simmons et al. | 5/600 |
| 6,691,349 | B2 | | 2/2004 | Blevins | |
| 6,694,549 | B2 | | 2/2004 | Perez et al. | |
| 6,742,202 | B2 | | 6/2004 | Jones | |
| 6,789,280 | B1 | | 9/2004 | Paul | |
| 6,820,294 | B2 | | 11/2004 | Shiery et al. | |
| 6,839,926 | B2 | | 1/2005 | Heimbrock et al. | |
| 6,886,200 | B2 | * | 5/2005 | Blyshak et al. | 5/611 |
| 6,907,631 | B2 | | 6/2005 | Heaton | |
| 7,124,456 | B2 | | 10/2006 | Palmatier et al. | |
| 2004/0231057 | A1 | | 11/2004 | Sabin | |
| 2005/0015878 | A1 | | 1/2005 | Bannister et al. | |

OTHER PUBLICATIONS

Stryker Medical "Gynnie OB/GYN Stretcher" Brochure depicting a stretcher on sale for more than one year prior to the filing of this application.

* cited by examiner

PATIENT SUPPORT APPARATUS

CROSS REFERENCE TO RELATED APPLICATIONS

This application is a continuation-in-part of U.S. patent application Ser. No. 10/917,244, filed Aug. 11, 2004, now U.S. Pat. No. 7,124,456 which is incorporated herein by reference in its entirety.

FIELD OF THE INVENTION

This invention relates to a patient support apparatus and, more particularly, to a patient support litter having a hydraulic elevating mechanism covered by a telescoping shroud, and a trigger-activated gas spring for a knee-gatch.

BACKGROUND OF THE INVENTION

Wheeled carriages for supporting a patient in a substantially horizontal position are well known and a representative example of an early version of such a device is illustrated in Dr. Homer E. Stryker's U.S. Pat. No. 3,304,116, the disclosure of which is incorporated herein by reference. Improvements to Dr. Stryker's innovative wheeled carriage have been made over the years. The patient support apparatus disclosed herein is another version of an improvement, which improvement is based upon the request received from the patient care industry for a light weight patient support apparatus and having features thereon which will minimize attendant injury as well as other features that are easily controllable by the attendant.

Accordingly, it is an object of this invention to provide a patient support apparatus, as aforesaid, wherein a gatch control is provided at the foot end of the litter frame for easy access by the attendant.

It is a further object of the invention to provide a patient support apparatus, as aforesaid, wherein an elevating mechanism is provided with an enveloping telescoping shroud readily secured to the base and litter of the patient support apparatus.

SUMMARY OF THE INVENTION

The objects and purposes of the invention are met by providing a patient support apparatus having a base, a litter frame, an elevation mechanism interconnecting the base to the litter frame and being configured to effect changes in elevation of the litter frame relative to the base. The litter frame includes a pair of laterally spaced and longitudinally extending support rails and a plurality of laterally extending support rails interconnecting the longitudinally extending support rails so that the litter frame has a rectangular configuration. Selected ones of the laterally extending support rails are mounted to the elevation mechanism. On the aforesaid litter frame there is mounted various modules, namely, (1) a patient support deck, (2) a set of lateral edge siderails, (3) a holder for bottled gas, (4) an attendant work surface, oriented beneath the head section when the head section is in a horizontal position, (5) a seat, thigh and foot section assembly, and (6) a head section having manipulatable controls thereon supportingly secured to the litter frame separately from the seat, thigh and foot section assembly.

BRIEF DESCRIPTION OF THE DRAWINGS

Other objects and purposes of the invention will be apparent to persons acquainted with apparatus of this general type upon reading the following specification and inspecting the accompanying drawings in which.

DETAILED DESCRIPTION

Figure 1:
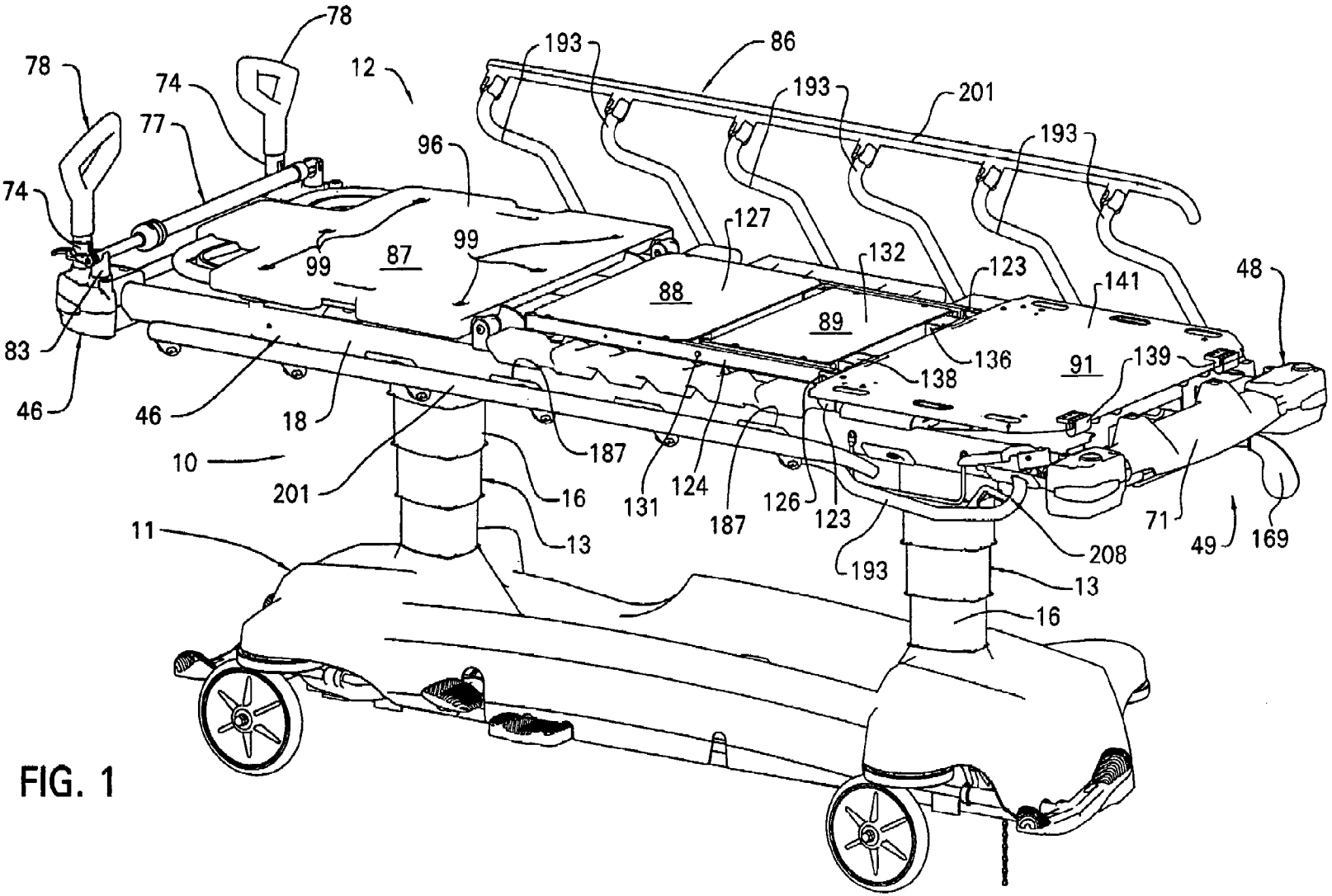
FIG. 1 is an isometric view of a patient support apparatus embodying the invention.
Figure 2:
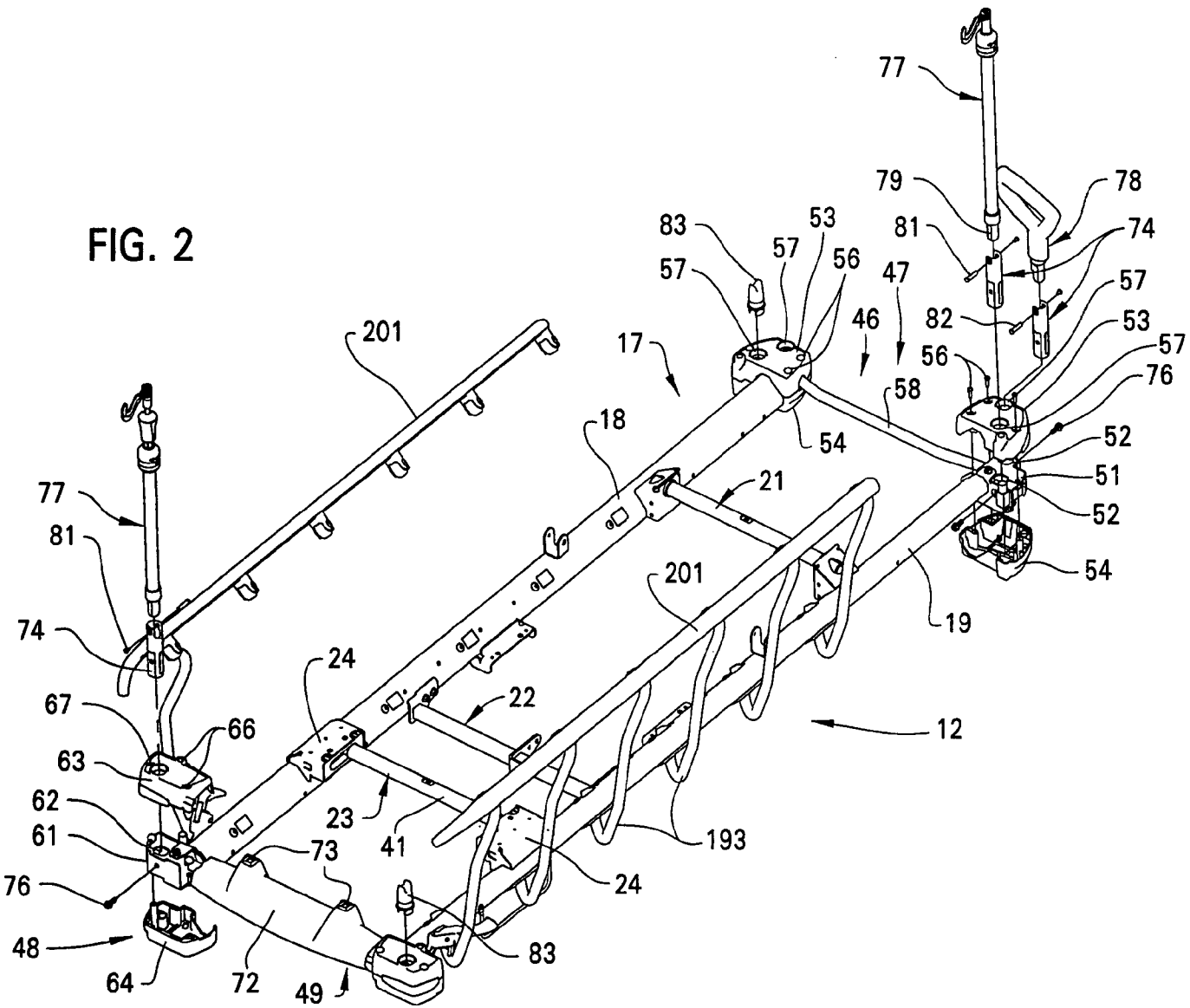
FIG. 2 is an isometric view of a litter frame embodied within the patient support apparatus and having at opposite longitudinal ends thereof modularized assemblies for facilitating attachment of at least one accessory.

Certain terminology will be used in the following description for convenience in reference only and will not be limiting. The words "up", and "down", "right" and "left" will designate directions in the drawings to which reference is made. The words "in" and "out" will refer to directions toward and away from, respectively, the geometric center of the patient support apparatus and designated parts thereof. Such terminology will include derivatives and words of similar import.

Figure 20:
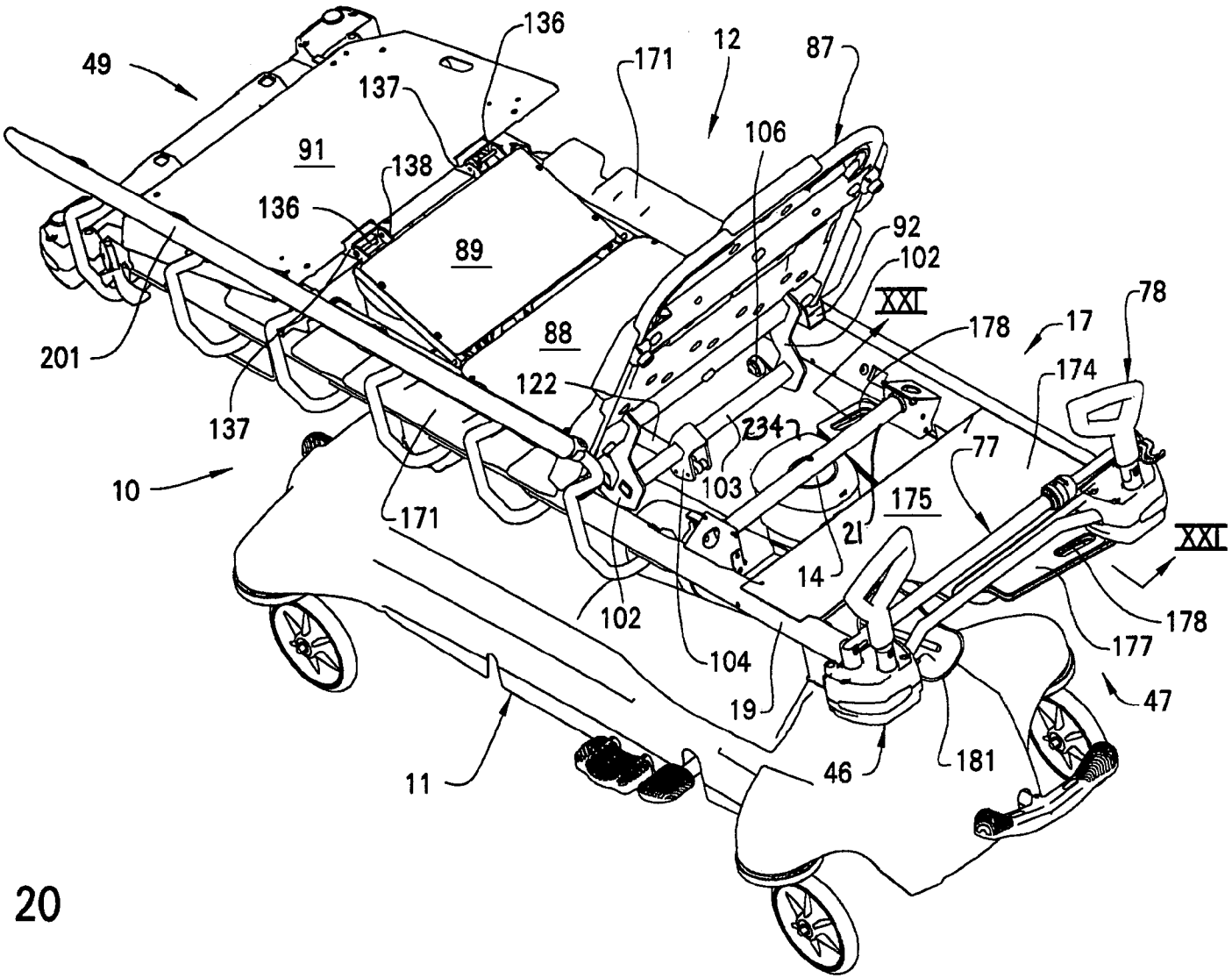
FIG. 20 is an isometric view of the patient support apparatus viewed from the head end of the litter frame and illustrating an attendant work surface oriented beneath the head section when the head section is in the horizontal position, the head section being illustrated in a raised position to provide attendant access to the work surface.
Figure 29:
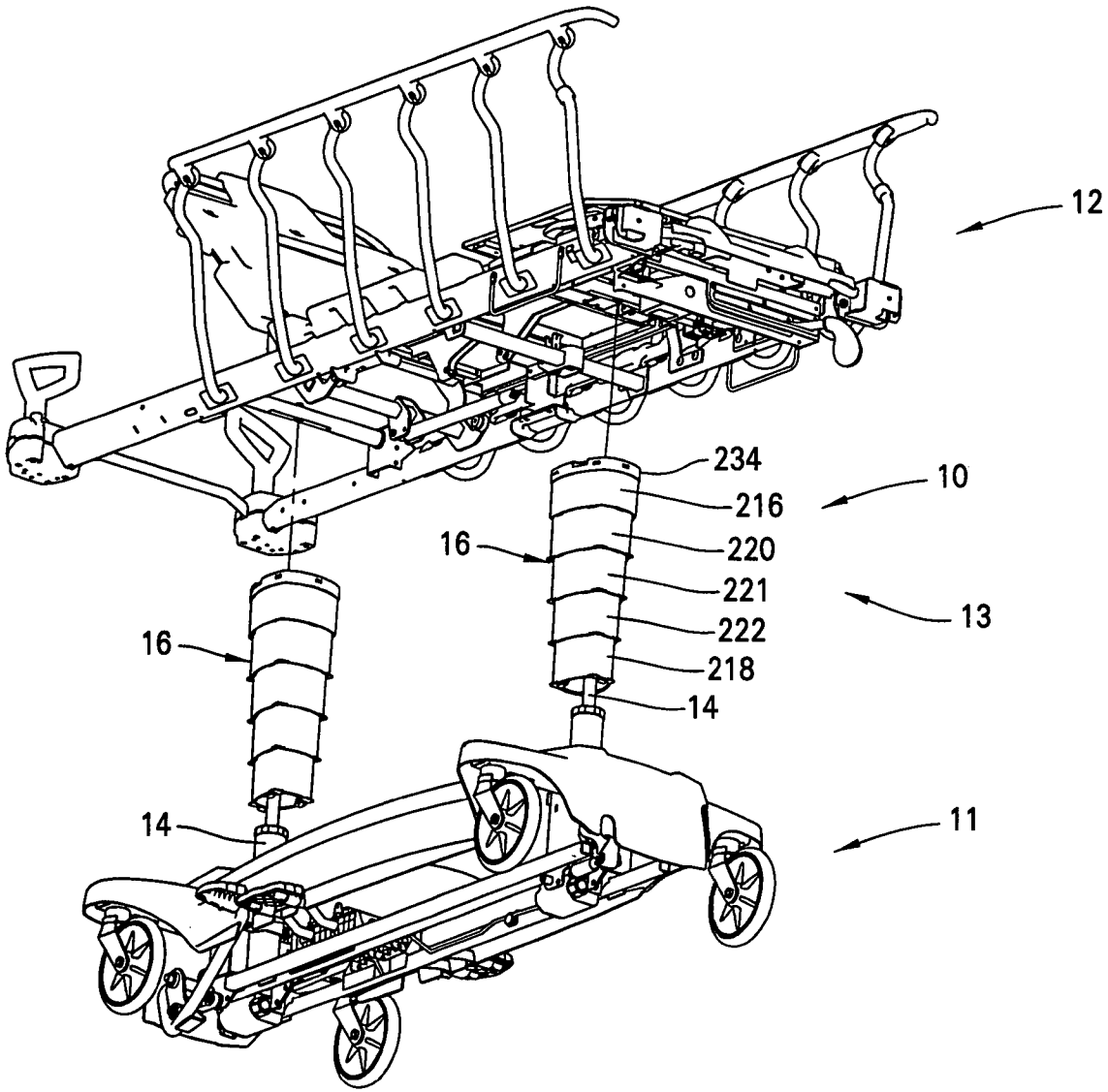
FIG. 29 is an exploded perspective view of a patient support apparatus with telescoping shroud assembly according to the invention.

FIG. 1 illustrates a patient support apparatus 10 embodying the invention. The patient support apparatus 10 includes a wheel supported base 11, a patient support litter 12 and an elevation mechanism 13 interconnecting the base 11 to the patient support litter 12 and being configured to effect a change in elevation of the patient support litter 12 relative to the base 11. The configuration of the base can be of many different varieties, one in particular being disclosed in U.S. patent application Ser. No. 10/083,234, filed Feb. 26, 2002, the disclosure of which is incorporated herein by reference. The elevation mechanism in this particular embodiment includes a pair of extendable and retractable hydraulic jacks 14, one of which is illustrated in FIGS. 20 and 29. Each of the jacks is enshrouded in a telescoping shroud 16, one end of which is mounted on the base 11 and the upper end of which is secured to the underside of the patient support litter 12.

The elevation mechanism 13 (FIG. 29) includes a pair of hydraulic jacks 14 connecting the base 11 and the litter frame 12 of the patient support apparatus 10. Each of the hydraulic jacks 14 is surrounded by a jack bellows, or telescoping shroud 16, concealing the respective hydraulic jack 14.

Figure 32:
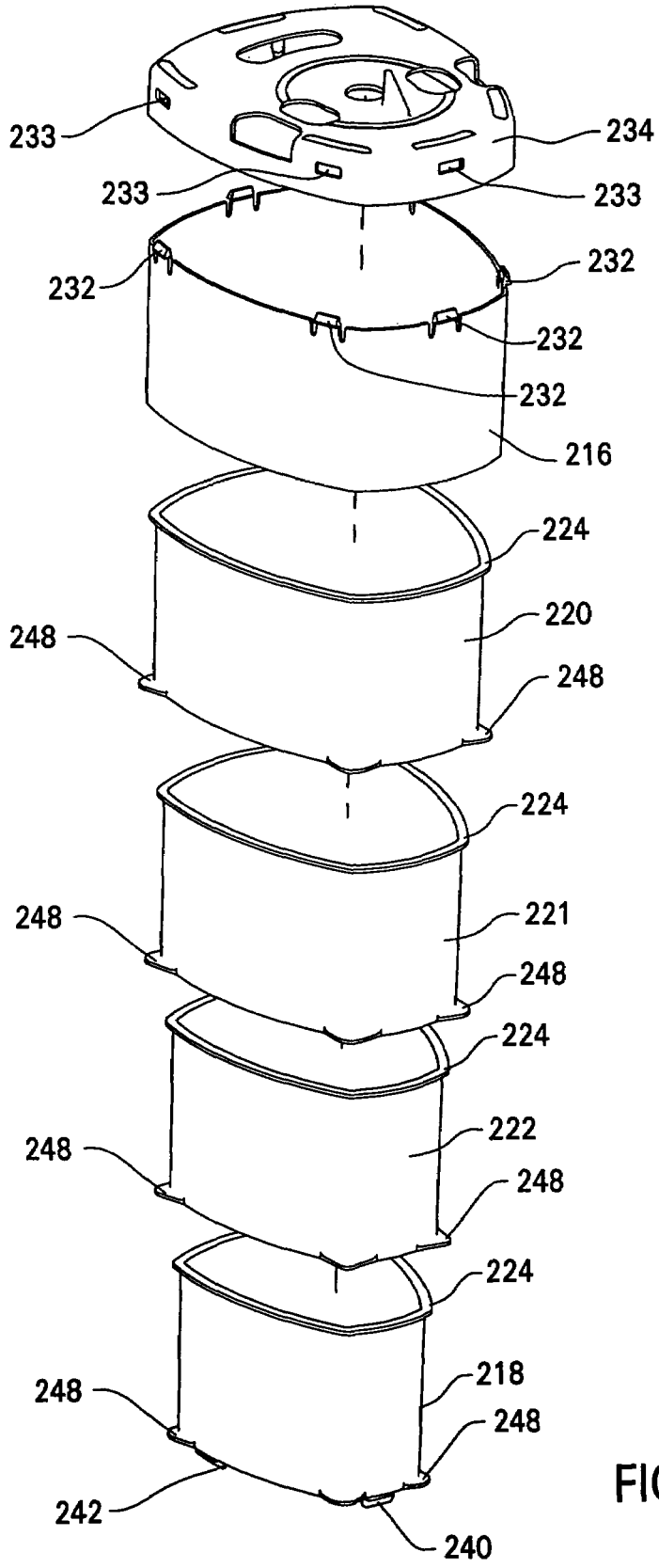
FIG. 32 is an exploded perspective view of the telescoping shroud of FIGS. 29-31.
Figure 36:
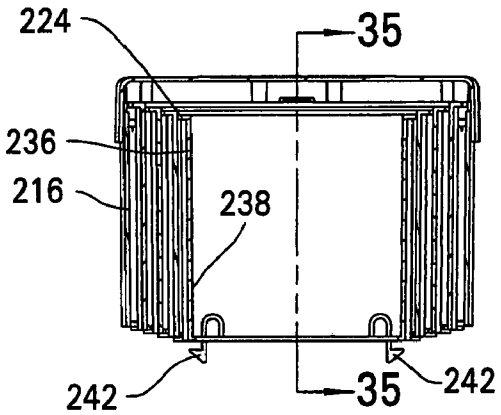
FIG. 36 is a cross-sectional front view of the telescoping shroud of FIGS. 29-35 in a compressed condition.
Figure 35:
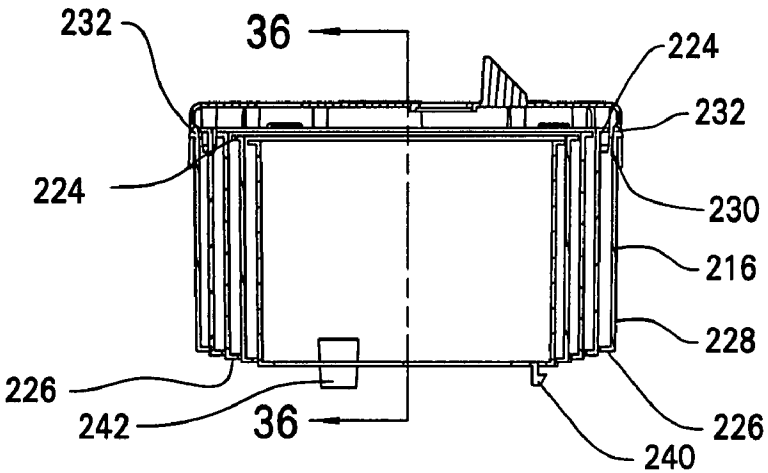
FIG. 35 is a cross-sectional side view of the telescoping shroud of FIGS. 29-34 in a compressed condition.
Figure 37:
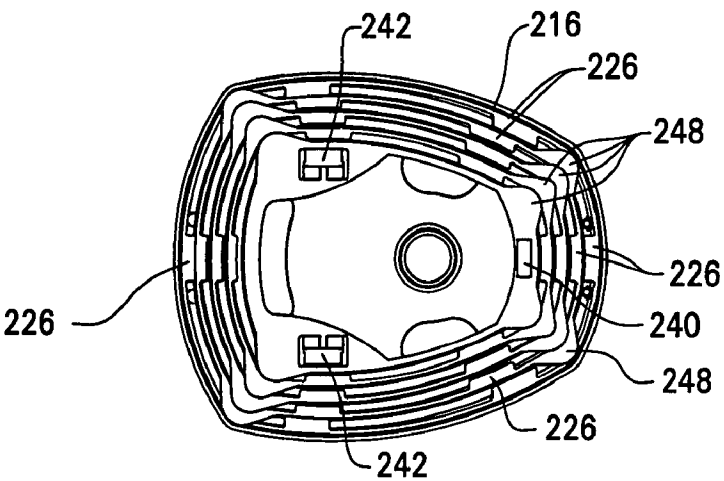
FIG. 37 is a bottom view of the telescoping shroud of FIGS. 29-36 in a compressed condition.
Figure 40:
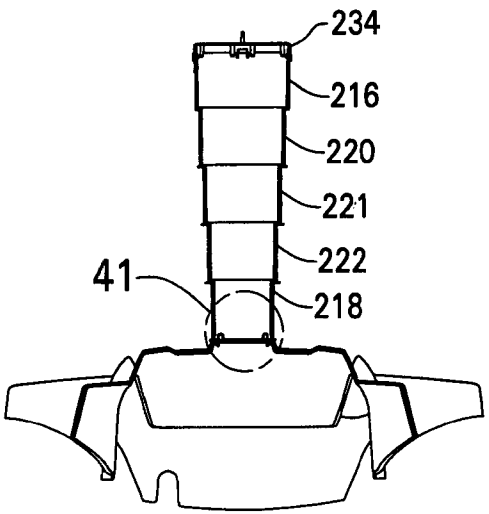
FIG. 40 is a partial cut-away front view of the telescoping shroud of FIGS. 29-39.
Figure 41:
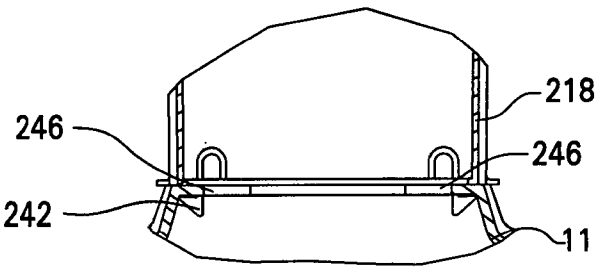
FIG. 41 is an enlarged detail view of the telescoping shroud according to FIG. 40.
Figure 38:
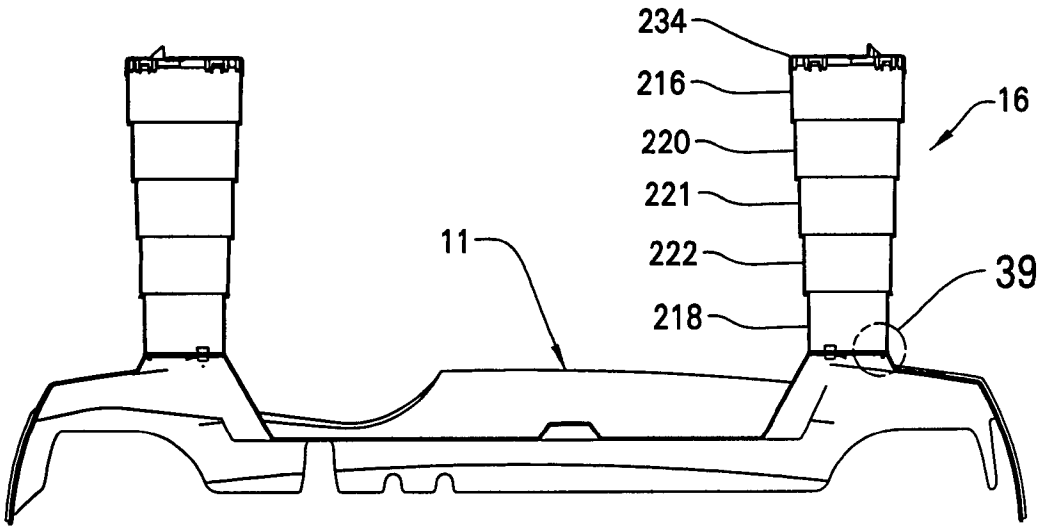
FIG. 38 is a partial cut-away side view of the telescoping shroud of FIGS. 29-37.
Figure 39:
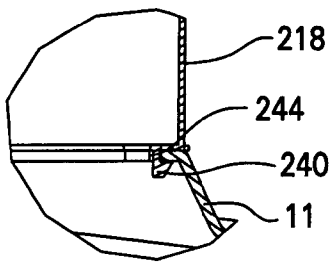
FIG. 39 is an enlarged detail view of the telescoping shroud according to FIG. 38.

The shroud 16 is formed by a plurality of shroud segments, including an uppermost shroud segment 216, a lowermost shroud segment 218, and a plurality of intermediate shroud segments 220, 221, 222. As shown in FIG. 32, each of the shroud segments 216-222 is generally tubular in nature, and is configured to fit around or inside of an adjacent shroud segment. Each shroud segment 216-222 also includes either an outwardly directed lip 224 (FIG. 32) or an inwardly directed lip 226 (FIGS. 35-37), or both. Each outwardly directed lip 224 is configured to engage an inwardly directed lip 226 of an adjacent shroud segment having a larger cross-section. Each inwardly directed lip 226 is correspondingly configured to engage an outwardly directed lip 224 of an adjacent shroud segment having a smaller cross-section. The shroud segments 216-222 are thereby prevented from sliding out from one another, forming the continuous, tapering shroud 16.

Figure 31:
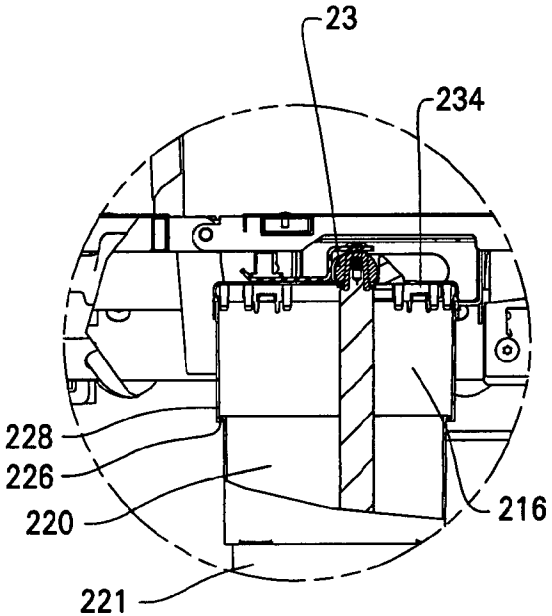
FIG. 31 is an enlarged detail view according to FIG. 30.
Figure 30:
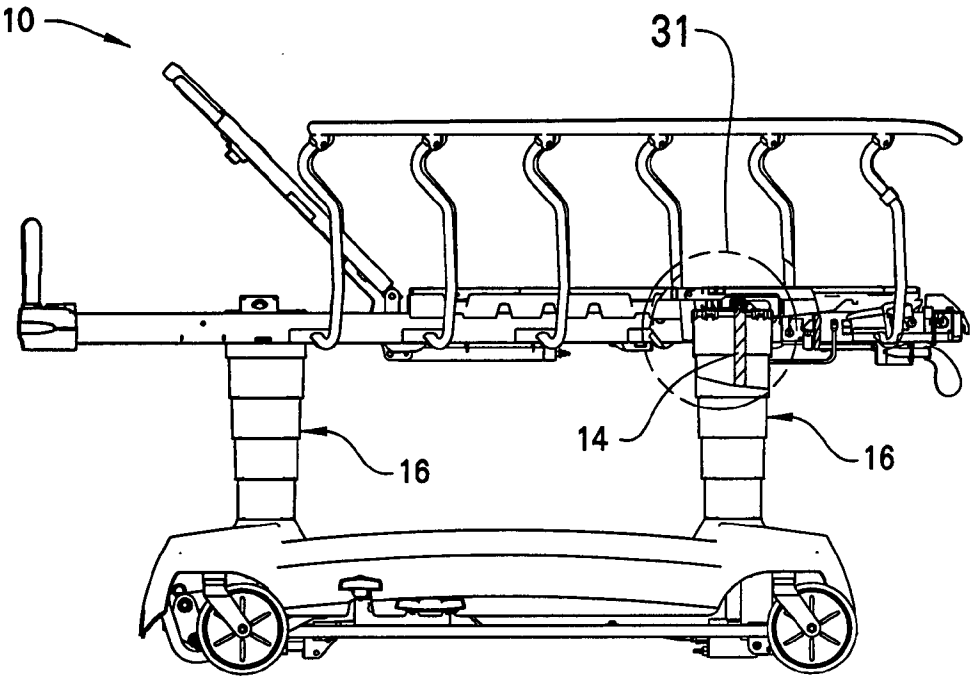
FIG. 30 is a partial cut-away side view of the telescoping shroud of FIG. 29.

The uppermost shroud segment 216 includes at its lower end 228 the inwardly directed lip 226 for engaging the next lower shroud segment 220. At its upper end 230, the uppermost shroud segment 216 includes a plurality of biased catches in the form of integrally molded hooks 232. These integrally molded hooks 232 are arranged to engage recesses 233 in a mounting plate 234 (FIG. 31) attached to a laterally extending support rail 21, 23 of the litter frame 12 (see also FIG. 20).

Figure 34:
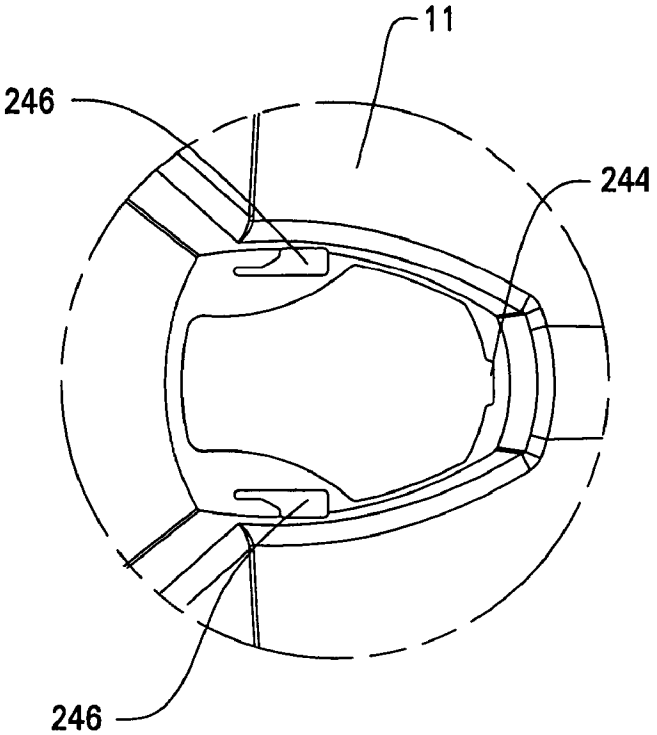
FIG. 34 is an enlarged detail view according to FIG. 33.
Figure 33:
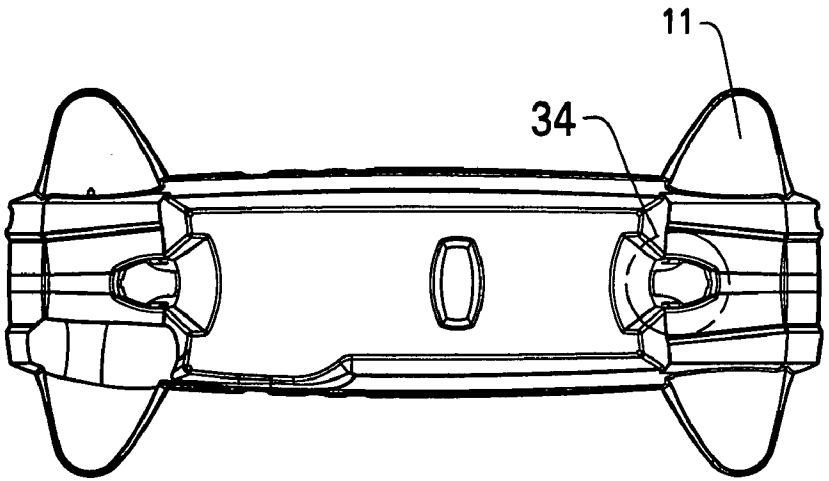
FIG. 33 is a plan view of the base of the patient support apparatus of FIG. 29.

The lowermost shroud segment 218 includes at its upper end 236 the outwardly directed lip 224 for engaging the next higher shroud segment 222. At its lower end 238, the lowermost shroud segment 218 includes a first, fixed catch 240, and a pair of spring catches 242. Each of the catches 240, 242 is configured to engage corresponding recesses 244, 246 (FIG. 34) on the base 11 of the patient support apparatus 10.

Each of the shroud segments 218-222 further includes at a lower extent thereof a plurality of outwardly extending wings 248. The wings 248 of each shroud segment 218-222 extend out further than the next higher shroud segment and are distributed about the perimeter of each shroud segment 218-222. The wings 248 thereby prevent the shroud segments 216-220 from inadvertently sliding lower than the next lower shroud segment 218-222 respectively. Thus, as the elevation mechanism 13 is lowered, the shroud segments 216-220 will sequentially lower.

Figure 22:
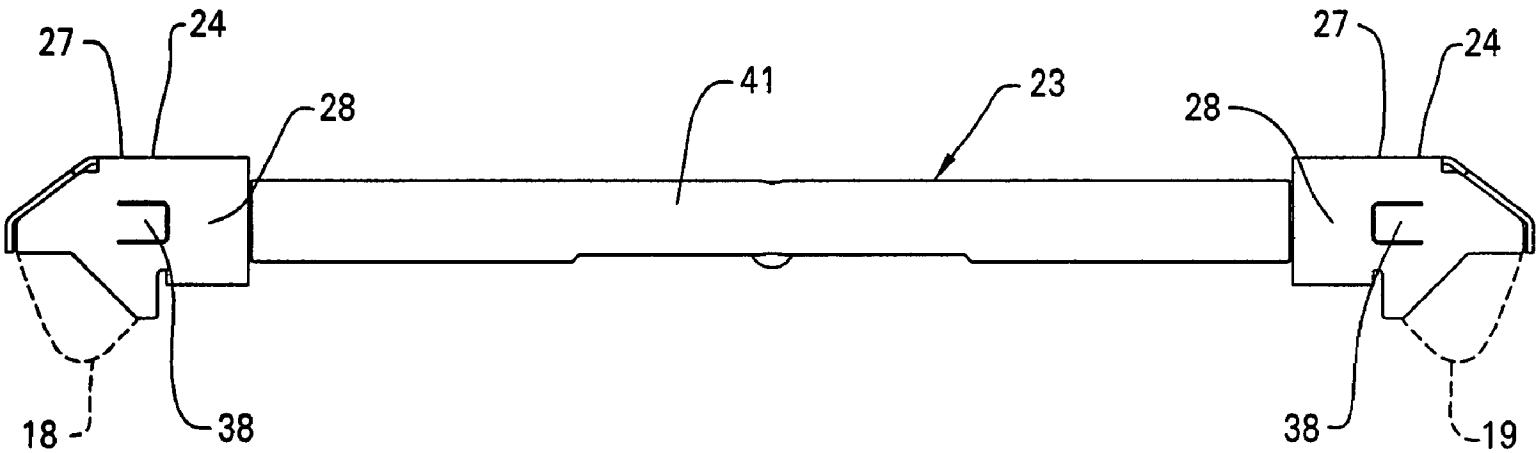
FIG. 22 is a side view of a laterally extending rail of the litter frame oriented adjacent the head end of the foot section.
Figure 23:
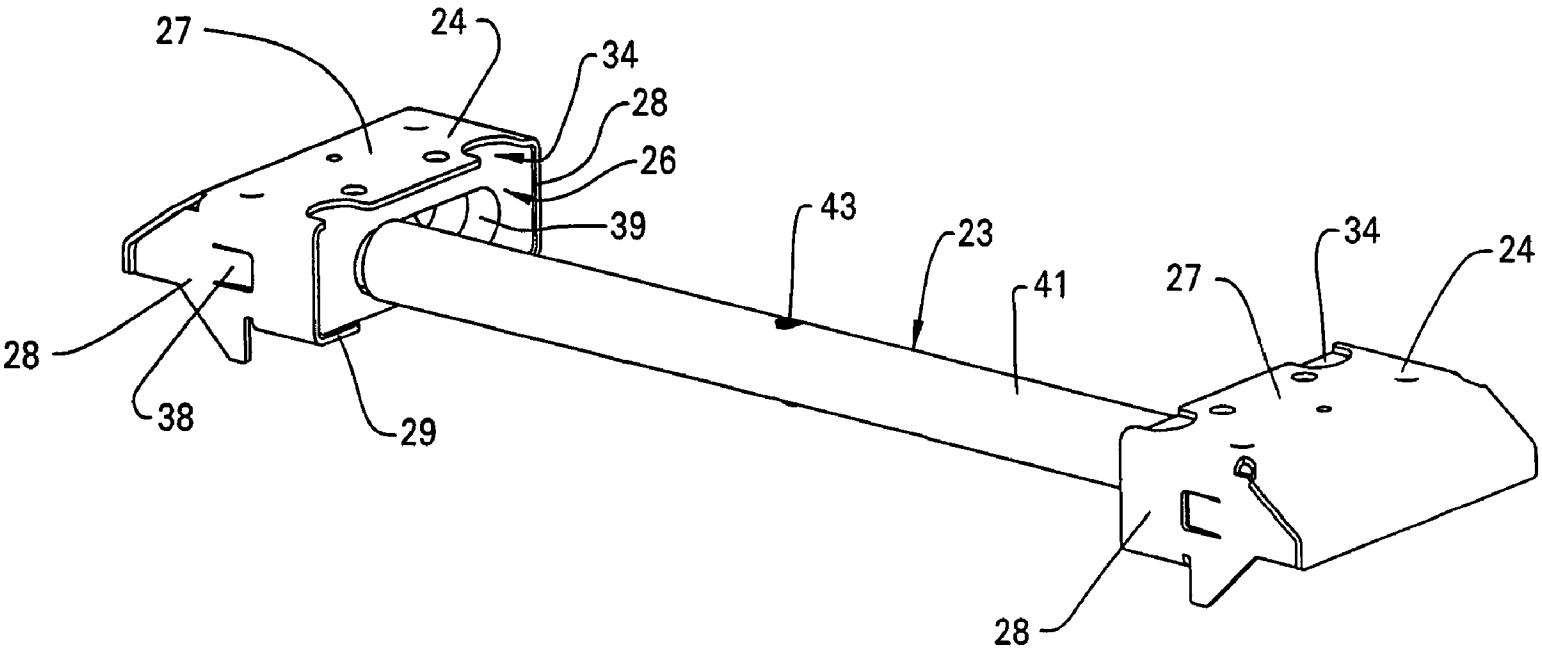
FIG. 23 is an isometric view of FIG. 22.
Figure 24:
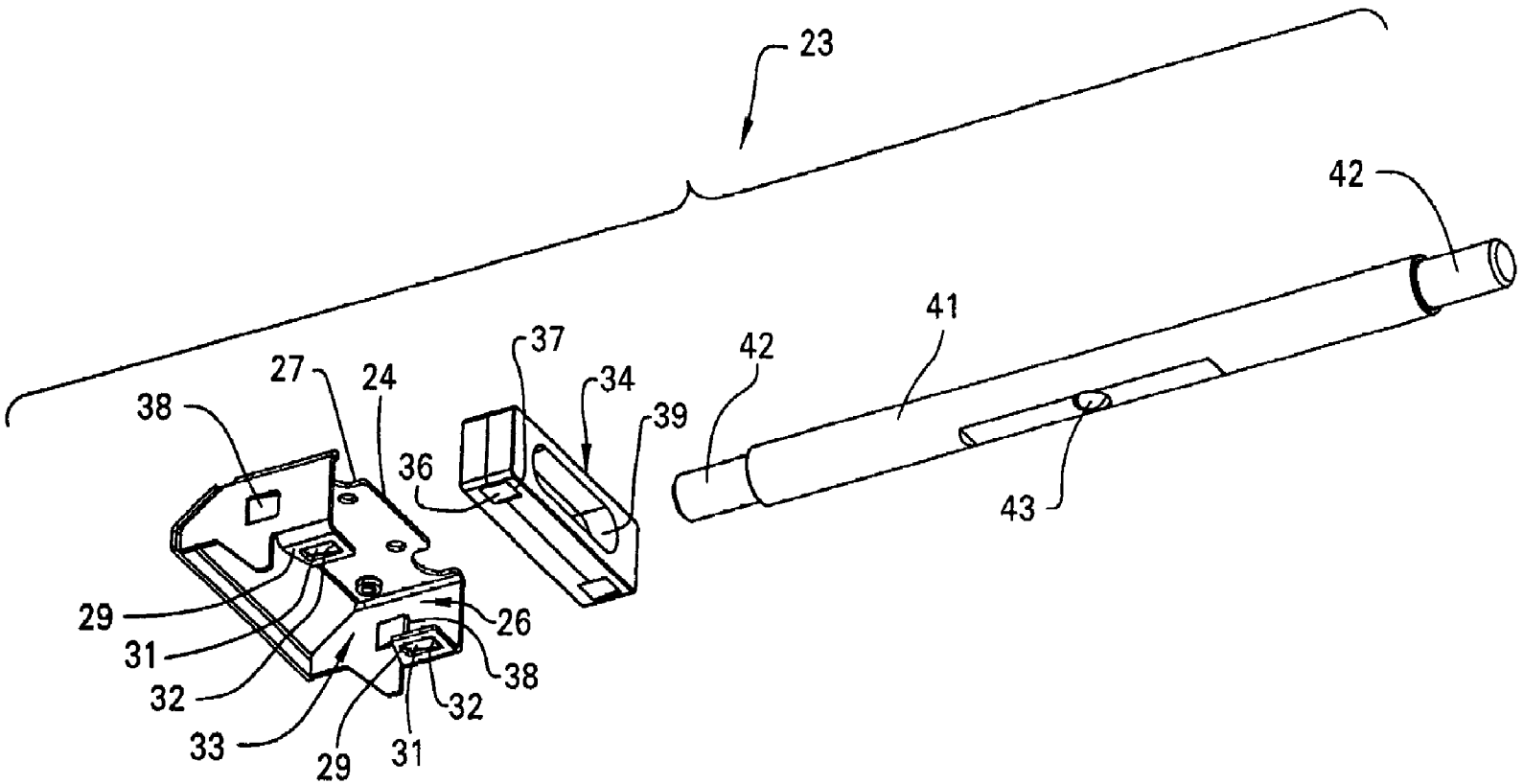
FIG. 24 is an exploded isometric view of the structure illustrated in FIGS. 22 and 23.
Figure 25:
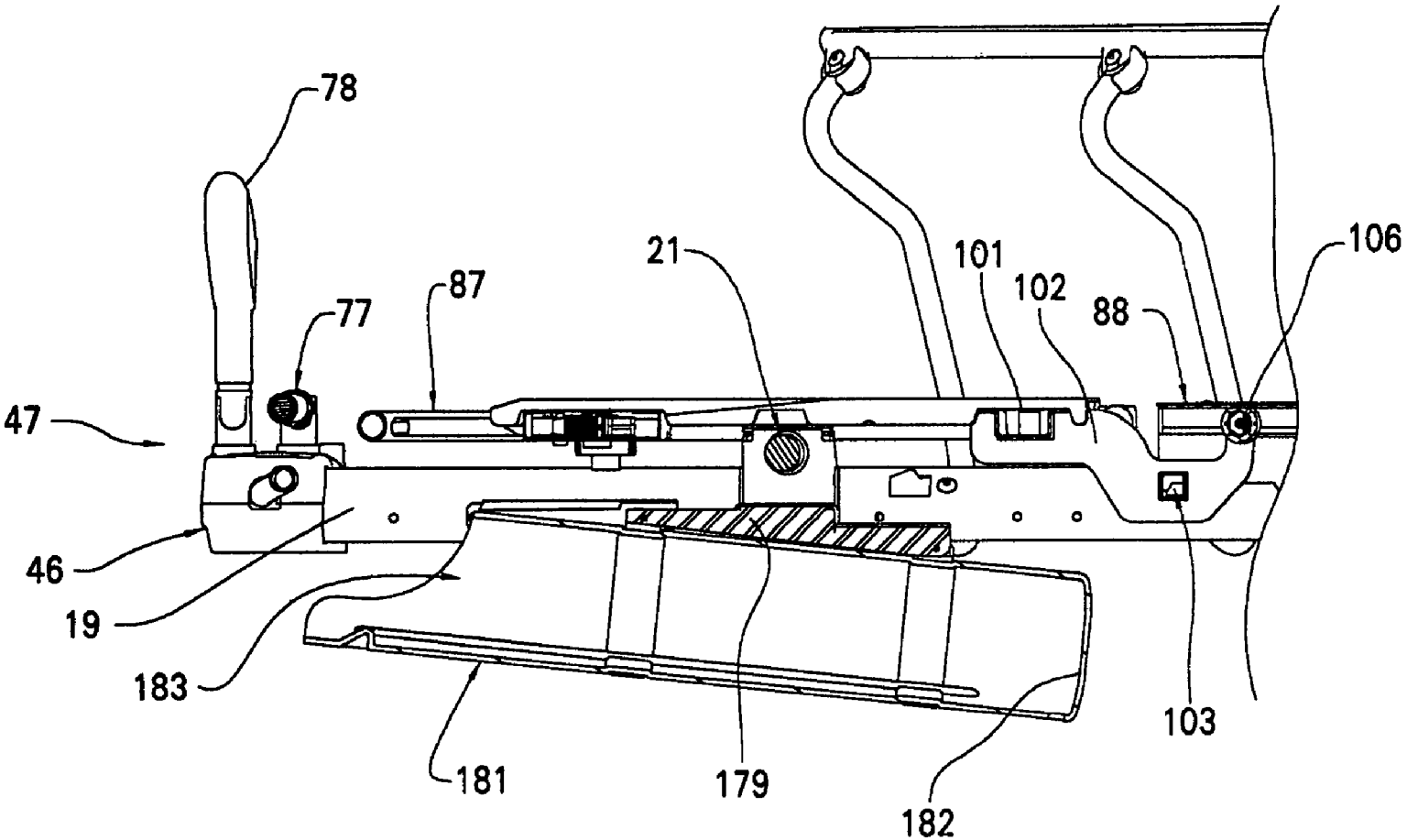
FIG. 25 is a sectional view taken along the line XXV-XXV in FIG. 5.

The patient support litter 12 includes a litter frame 17 which includes a pair of laterally spaced, longitudinally extending, tubular support rails 18 and 19 and plural laterally extending support rails 21, 22 and 23. The tubular support rails 18 and 19 each have a wholly enclosed hollow interior. Further, the tubular support rails can have a welded longitudinally extending seam or be of a seamless configuration. In this particular embodiment, the support rails have a non-circular cross section. The lateral extending support rails 21, 22, and 23 interconnect the longitudinally extending support rails 18 and 19. Further, the laterally extending support rails 21 and 23 are supported on the extendable and retractable component of the aforementioned hydraulic jacks 14. Further detail concerning the lateral support rail 23 is illustrated in FIGS. 22, 23 and 24. More specifically, and referring to FIGS. 22-24, a bracket 24 is secured to each of the support rails 18 and 19. Each of the brackets 24 defines a hollow housing having an outwardly facing opening 26 opposing the opening 26 in the other hollow housing. FIG. 24 illustrates in more detail one of the brackets 24. It includes a top wall 27, a pair of side wall skirts 28 depending therefrom with the lower ends of the respective side wall skirts 28 having inwardly projecting flanges 29. Each of the flanges 29 has a hole 31 therein, a fragment 32 of an edge of the hole 31 defining a lip, the purpose of which will be explained below. In this particular embodiment, the top wall 27 and the flanges 29 are contained in vertically spaced horizontal planes. Further, each of the two brackets 24 are identical and has a contour configured to conform to the outer contour of the support rails 18 and 19 to facilitate a welded securement thereof to the respective support rail 18 and 19. The interior of the bracket defines a socket 33 into which is received a block body 34 having a pair of spaced protuberances 36 thereon which, when said block body 34 is received into the socket 33, project into the holes 31 so that an edge 37 of each of the protuberances 36 will operatively engage the edge fragments 32 of the respective holes 31 to securely hold the block body into the socket 33. Each of the side wall skirts 28 has a stop 38 formed thereon to limit the extent to which the block body 34 can move into the socket 33. The block body includes an elongate slot 39 therein. In this particular embodiment, each of the block bodies 34 is made of a synthetic resin material and is preferably a molded component.

The lateral support rail assembly 23 additionally includes a support rail 41 having reduced diameter ends 42 each configured to be received in a selected one of the slots 39 in a respective one of the block bodies 34 and be slideable lengthwise along the length of the respective slots 39. The midsection of the support rail 41 has a hole 43 extending therethrough to facilitate connection to the extendable and retractable component of the respective hydraulic jack 14.

The litter frame 17 has a rectangular configuration and each corner of the rectangle is provided with an accessory mount assembly 46 secured to the head end 47 of the litter frame 17 and a further accessory mount assembly 48 secured to the foot end 49 of the litter frame 17. The accessory mount assembly 46 includes an accessory mount frame 51 secured to each of the support rails 18 and 19 at the head ends thereof. Each of the accessory mount frames 51 has plural receptacles therein, the axis of each of which extends vertical and perpendicular to a horizontal plane defined by the litter frame 17. A support rail 58 is secured to and extends between the accessory mount frames 51. The accessory mount assembly 46 further includes a pair of shell-like covers 53 and 54 enclosing the accessory mount frame 51. The covers 53 and 54 are secured together by plural fasteners 56. The uppermost cover 53 has plural holes 57 therein which are aligned with the receptacles 52 when the covers 53 and 54 are secured to one another by the fasteners 56

Similarly, the accessory mount assembly 48 is secured to each of the longitudinally extending support rails 18 and 19 at the foot ends thereof. Each of the accessory mount frames 61 includes at least one receptacle 62 therein, the axis of which extends vertical and perpendicular to a plane containing the litter frame 17. A support rail 68 is secured to and extends between the accessory mount frame 61. The accessory mount assembly 48 additionally includes a shell-like set of covers 63 and 64 which enshroud each of the accessory mount frames 61. The covers 63 and 64 are secured to one another by plural fasteners 66. The uppermost cover 63 includes at least one hole therein which is aligned with the respective receptacle 62 when the covers 63 and 64 are secured to one another by the fasteners 66. A bracket 69 is secured to the support rail 68 and has a pair of vertically upright sockets 71 thereon. The bracket 69 is covered by a shroud 72 which has holes 73 therein aligned with the sockets 71. The sockets 71 provide support for an accessory to the patient support apparatus, such as a footboard not illustrated.

Figure 19:
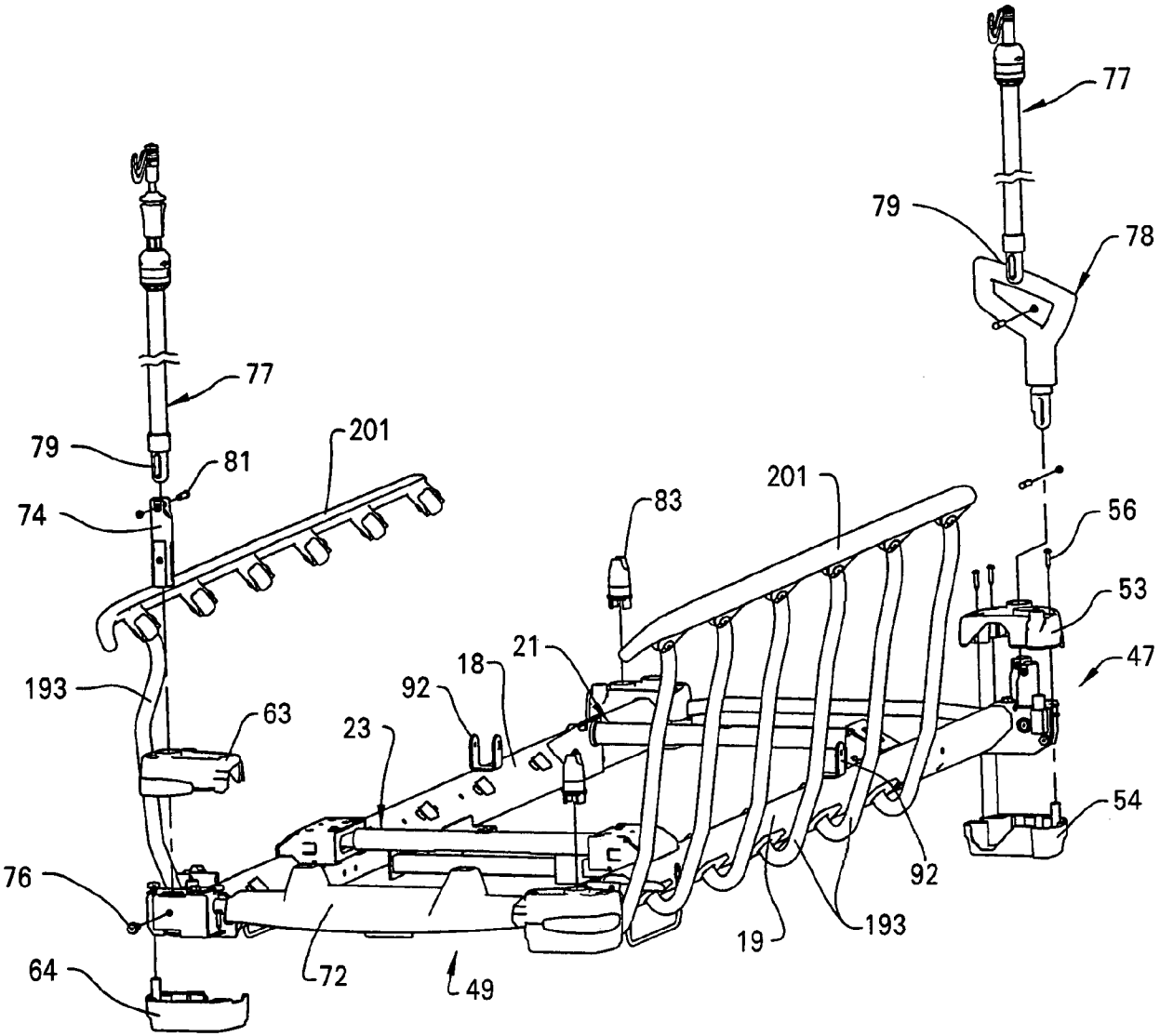
FIG. 19 is an exploded isometric view of FIG. 18.

Each of the receptacles 52 and 62 are configured to selectively receive therein a holder base unit 74 that is configured to be held in the respective receptacles 52 and 62 by a fastener 76. Each holder base unit has a lower end that is configured to be snugly received into any selected receptacle 52 and 62. Further, each holder base unit has a clevis type upper end into which is received a selected accessory 77 and 78. In this particular embodiment, the accessory 77 is an IV pole having a lower end (FIG. 19) with an elongate slot 79 therein received between the arms of the clevis so that a pin 81 can be received through the slot and through aligned holes in the arms of the clevis to facilitate a pivotal securement of the IV pole to the holder base unit 74. The interior of the holder base unit 74 is hollow in the region immediately beneath the clevis arms to facilitate a snug holding of the lower end of the IV pole and to keep the IV pole sturdily in an upstanding position wherein the longitudinal axis thereof is perpendicular to the plane of the litter frame. The IV pole accessory 77 can be pivoted to a position 90 degrees relative to the upstanding position, namely, a position wherein the longitudinal axis is in a horizontal plane parallel to the plane of the litter by simply lifting up on the IV pole accessory 77 until the pin 81 is at the lower end of the longitudinal slot 79 at which time the lower end of the IV pole will be removed from the hollow interior of the holder base unit 74 to facilitate the aforesaid pivoting movement.

The other accessory 78 is a push handle which has a lower end configuration identical to the configuration of the IV pole namely, it too has a slot therein into which is received a pin 82, which pin also extends through aligned holes in the arms of the clevis on the holder base unit. The handle will be snugly held in an upstanding position by reason of the lower end thereof being received into the hollow portion of the holder base unit 74 and when it is desired to orient the push handles at a position that is 90 degrees spaced from the upstanding position, it is only necessary to lift the accessory handles upwardly so that the pin 82 will be shifted in the slot to the lower end thereof to enable the handle to be pivoted to a position that is generally horizontal and stowed.

A further accessory 83 can be provided and consists solely of a holder base unit received into a selected one of the receptacles 52 or 62 and has a pair of clevis type arms thereon between which the top end of the aforesaid IV pole accessory 77 can be received after it has been pivoted to the aforesaid horizontal stowed position to securely hold the IV pole accessory in the stowed position. The accessory 83 can be secured into the selected receptacle 52 or 62 by a fastener not illustrated. The IV pole is of the type disclosed in U.S. Pat. No. 5,924,658, the disclosure therein being incorporated herein by reference.

Figure 3:
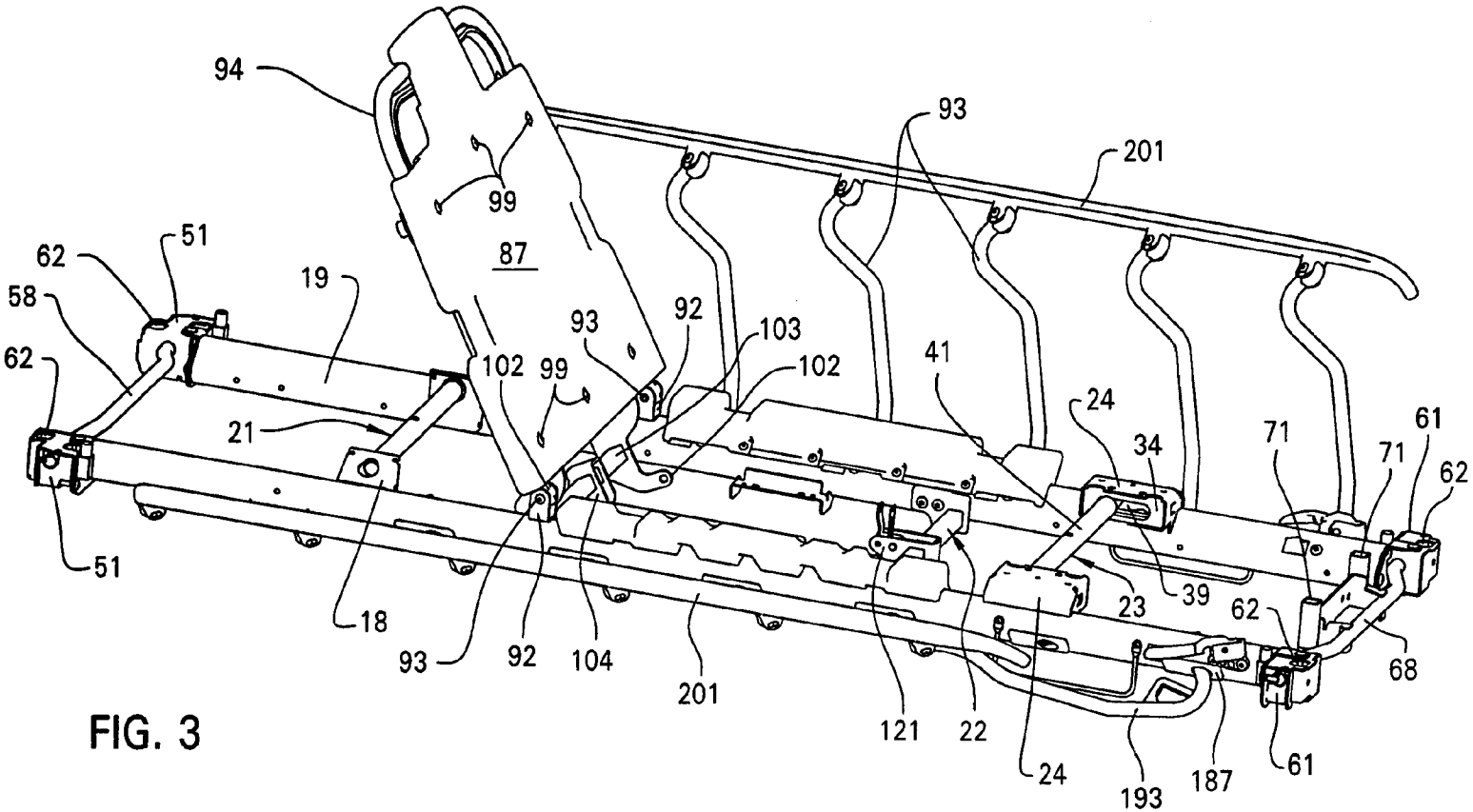
FIG. 3 is an isometric view of the litter frame having mounted thereon a head section.

A patient support deck 86 is mounted on the litter frame 17 and, in this particular embodiment includes a head section 87, a seat section 88, a thigh section 89 and a foot section 91. As illustrated in FIG. 3, each support rail 18 and 19 has a clevis type bracket 92 secured to the upper side thereof. Each bracket 92 has a pair of upstanding arms with each arm having a hole therethrough configured to receive a fastener pin 93. The head section 87 includes a U-shaped frame 94 component (see also FIGS. 15-17) with the distal ends of each of the arms of the U-shaped frame being received between the arms of the clevis bracket 92 to facilitate securement of the arms of the frame to the bracket 92. A synthetic resin shroud 96 defines the patient support surface for the head section 87. A synthetic resin body 97 with plural cavities 98 therein is also mounted to the frame 94 to render the U-shaped frame 94 more rigid. The shroud 96 is secured to the body 97 by a plurality of fasteners 99 (FIGS. 1 and 3)

Figure 7:
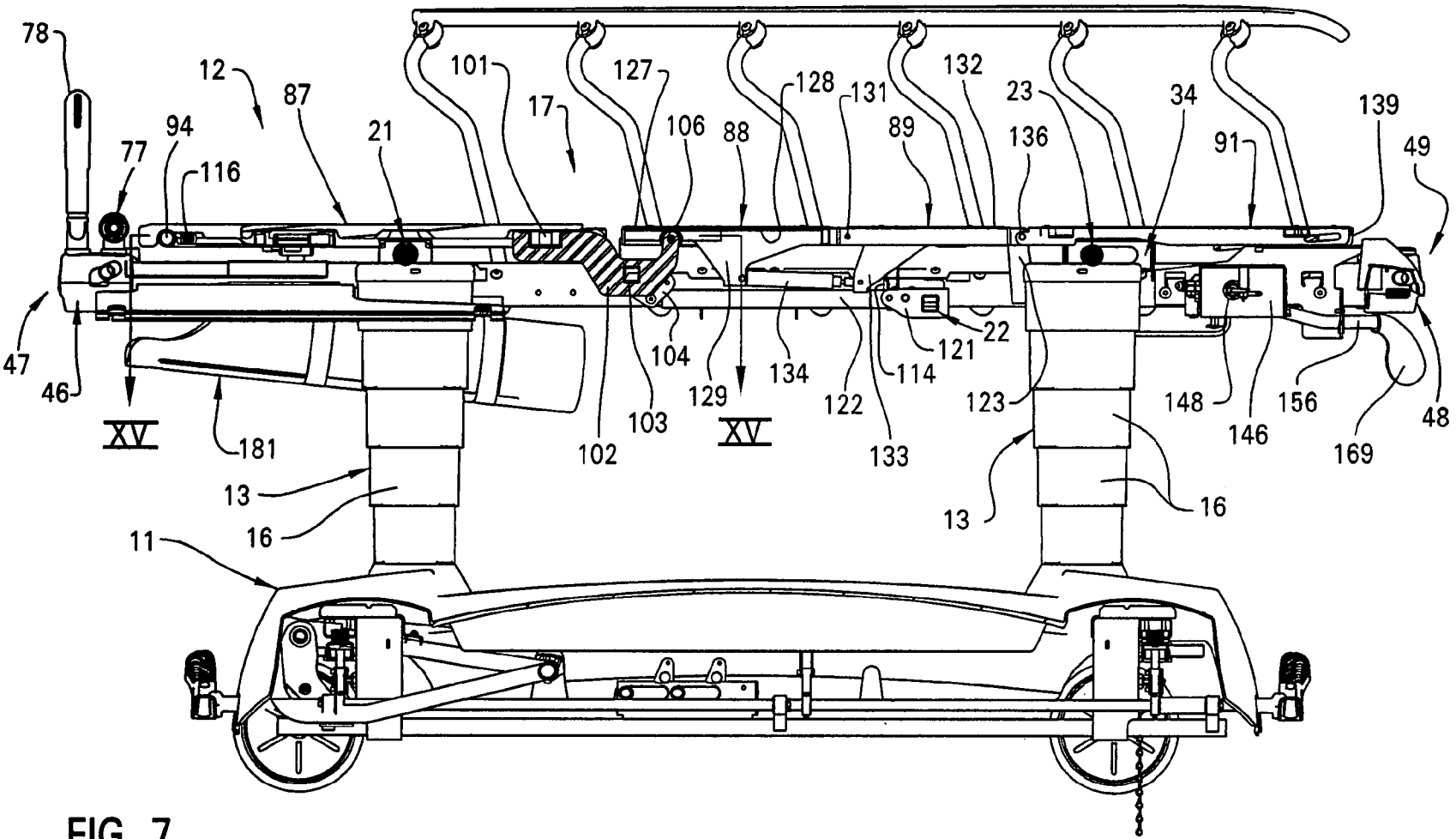
FIG. 7 is a sectional view taken along the line VII-VII of FIG. 5.

A laterally extending support bar 101 (FIG. 17) is secured to the frame 94 and extends between the arms thereof adjacent the distal ends of the arms. A pair of laterally spaced bracket arms 102 is secured to the support bar 101 and extends toward the foot end of the litter frame 17. A further support bar 103 is secured to each bracket arm 102 and extends laterally between the bracket arms 102 to stabilize them. An actuator attachment bracket 104 is secured to the support bar 103. In this particular embodiment, the actuator attachment bracket 104 is of a U-shaped clevis type. The distal end of each of the bracket arms 102 has a roller 106 rotatably secured thereto as illustrated in FIGS. 7 and 20.

Figure 15:
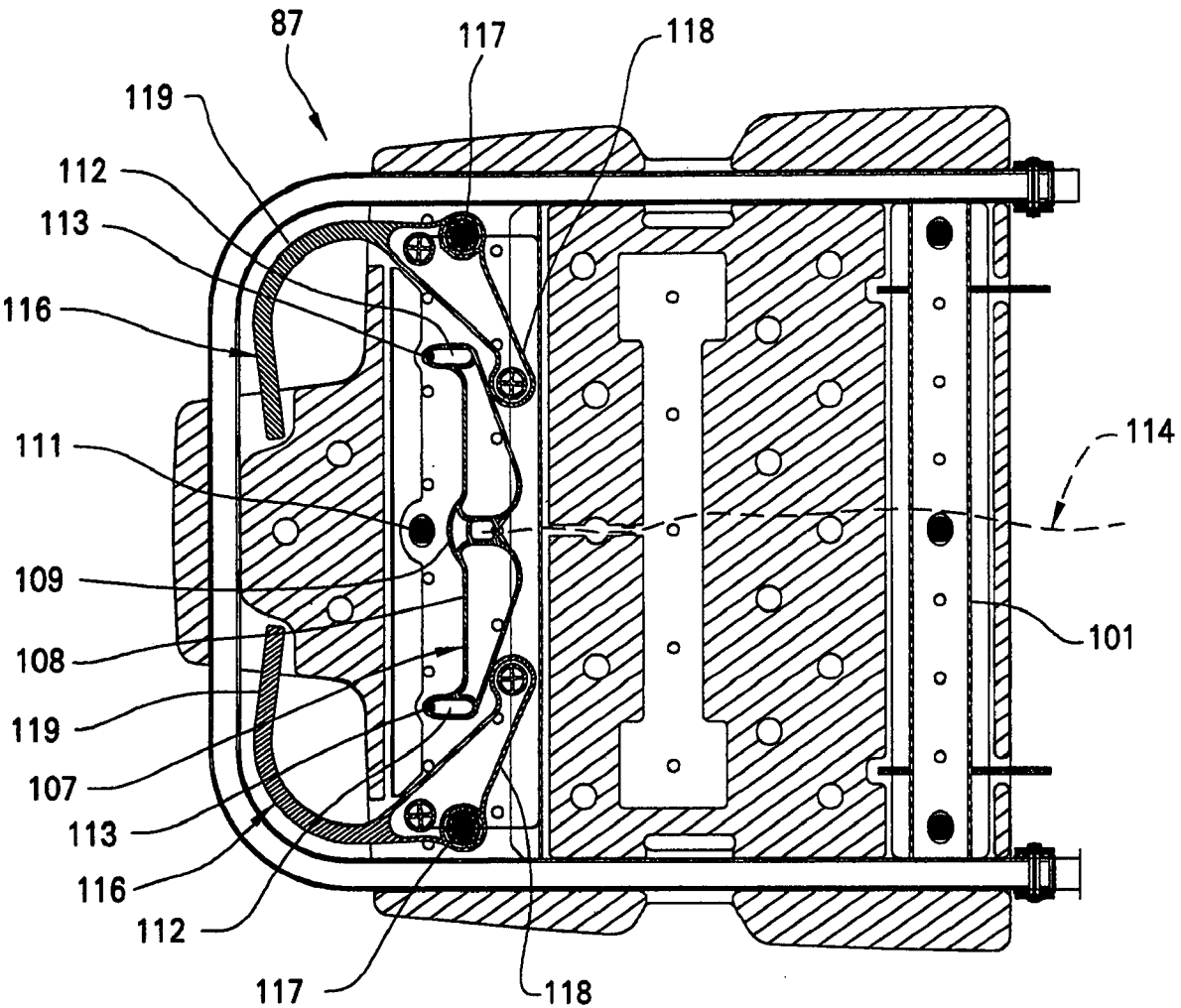
FIG. 15 is a sectional view taken along the line XV-XV in FIG. 7.
Figure 16:
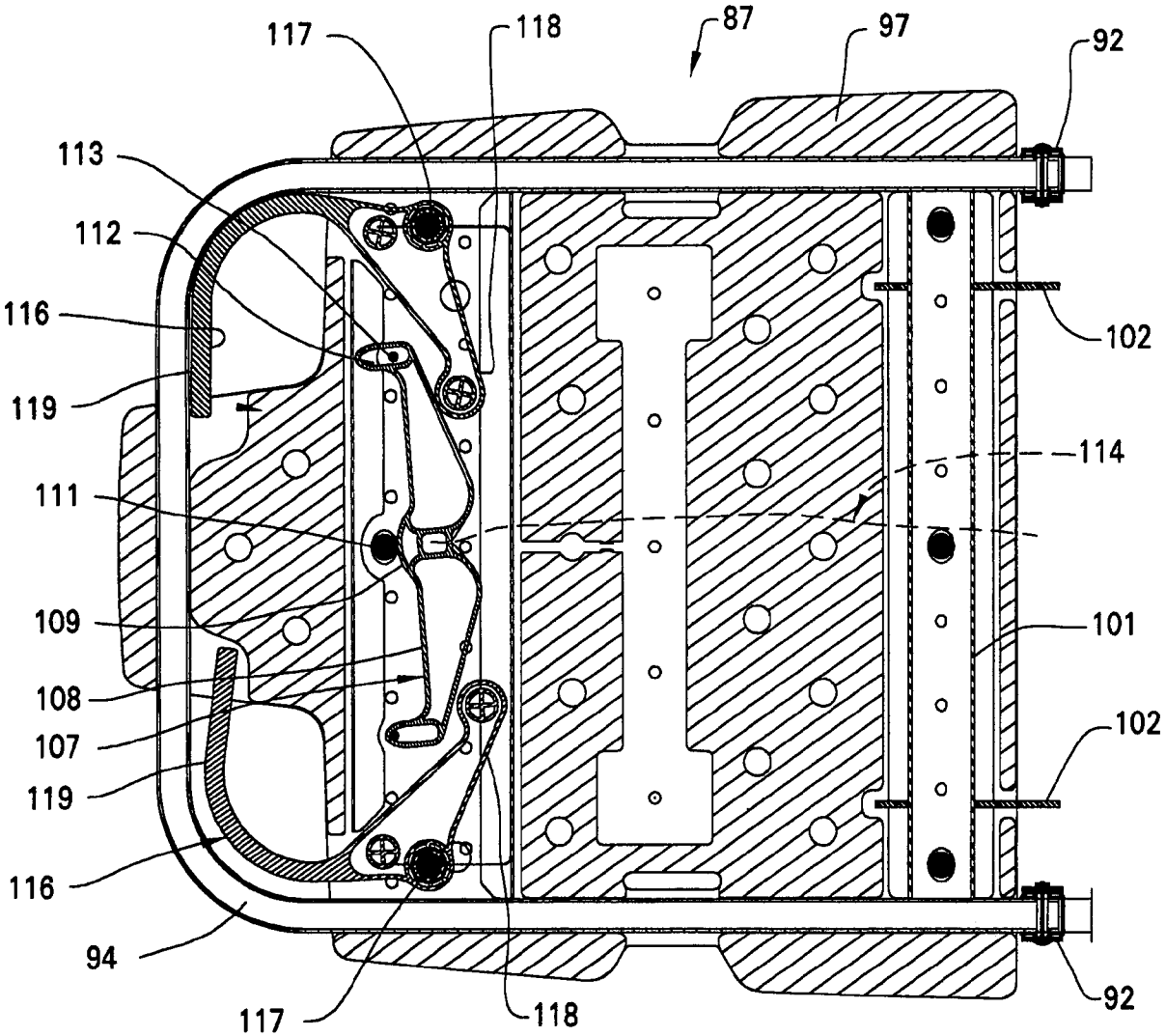
FIG. 16 is a view similar to FIG. 15 except that one of the handles has been moved to a different position.
Figure 17:
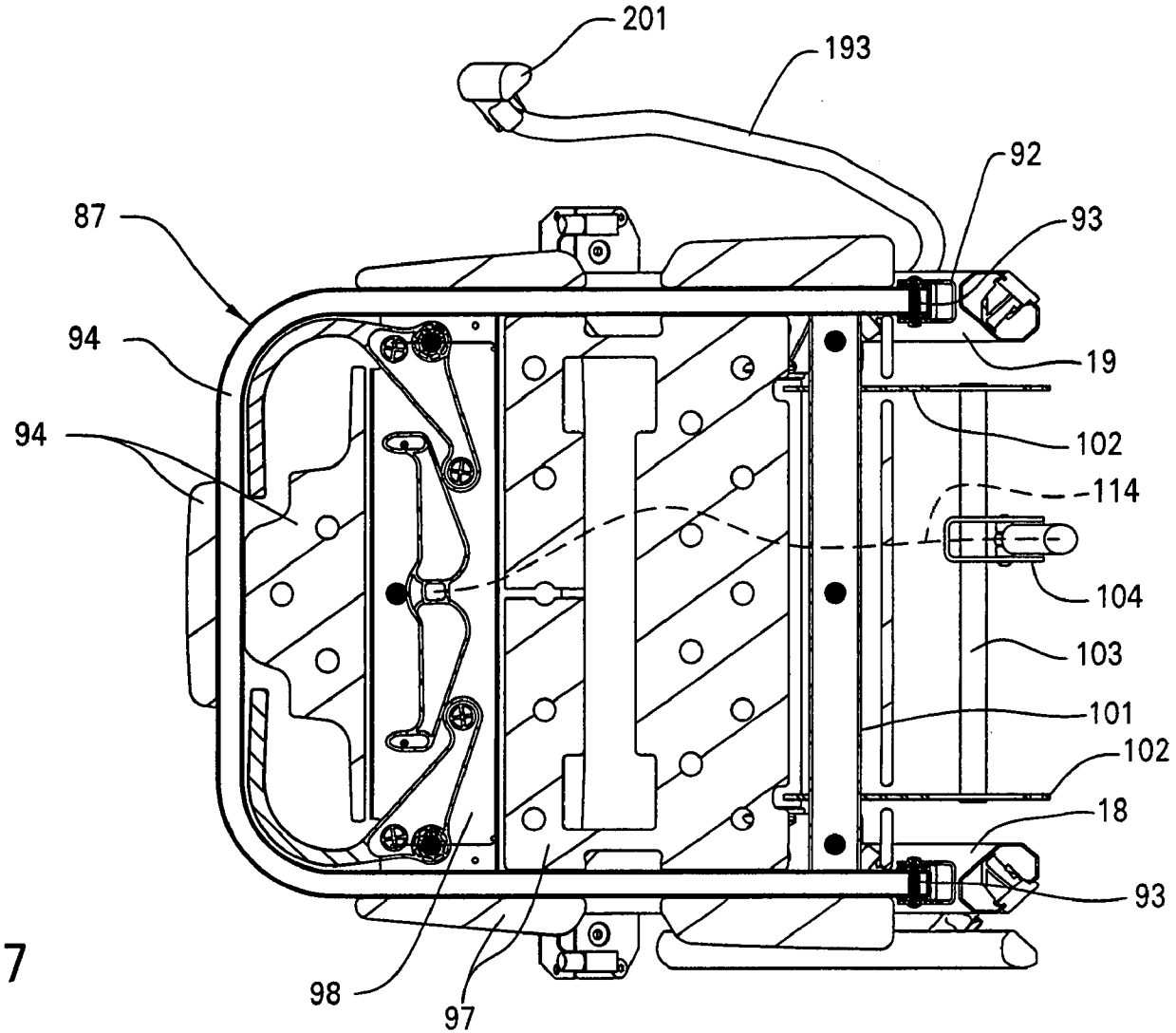
FIG. 17 is a view similar to FIG. 15 except that both of the handles have been moved to a further position.
Figure 18:
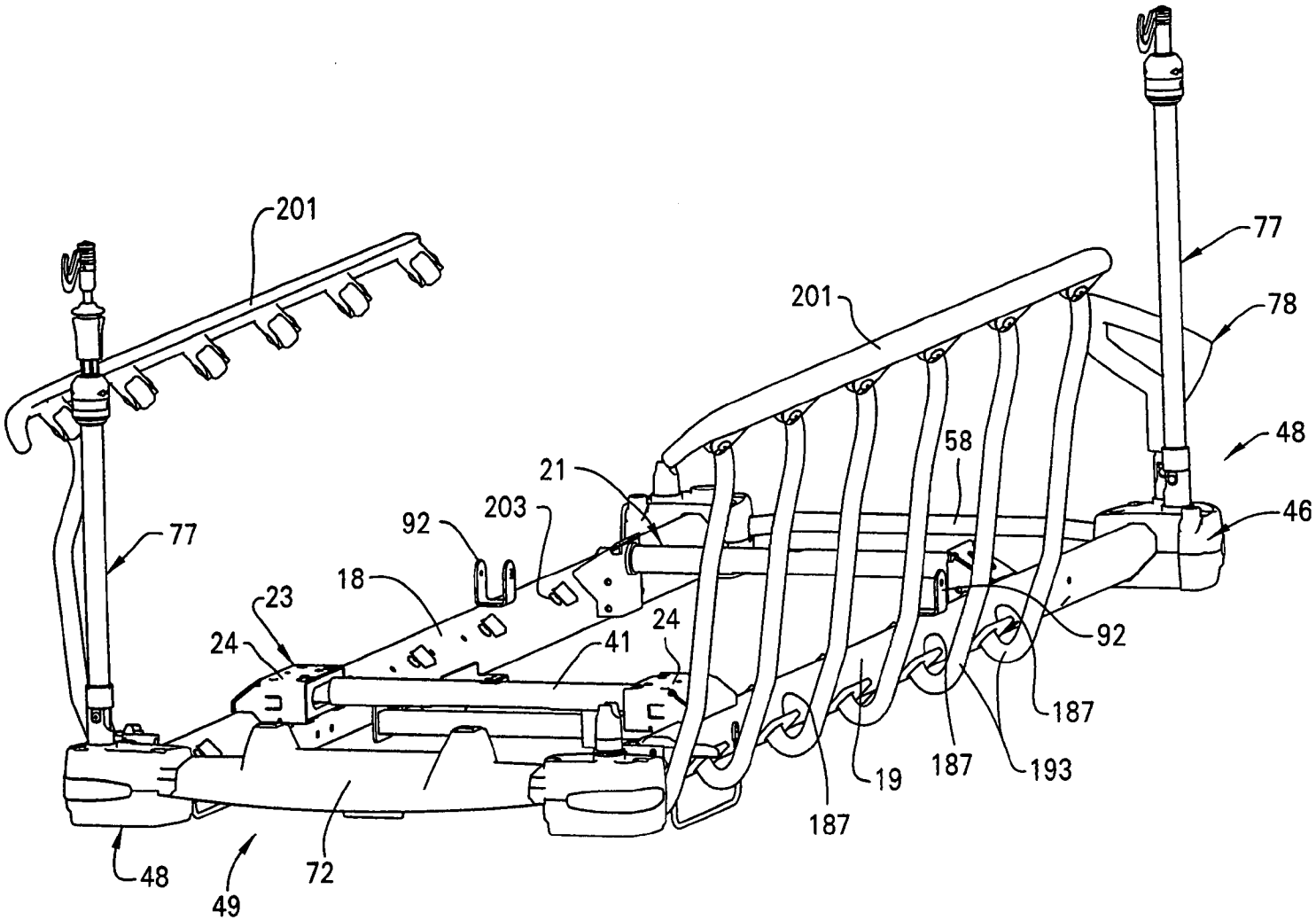
FIG. 18 is an isometric view similar to FIG. 2.

As illustrated in FIGS. 15-17, one of the cavities 98 in the body 97 has an actuator control member 107 mounted therein. In this particular embodiment, the actuator control member 107 is a two arm lever 108 having a mid-section 109 defining a fulcrum configured to engage an abutment 111 fixedly provided on the body 97 adjacent the mid-section 109. The distal end of each arm of the two arm lever 108 has an elongate slot 112 provided thereon and being elongate in a direction parallel to the longitudinal axes of the support rails 18 and 19. A pin 113 is fixedly secured to the body 97 and is received in each elongate slot 112. A Bowden cable (illustrated in broken lines in FIGS. 15-17) is attached to the mid-section 109 of the two arm lever 108.

Adjacent each end of the two arm lever 108 there is provided a two arm lever 116 defining a handle. Each handle 116 is identical to the other and is pivotally secured to the body 97 by a pin 117 oriented at the mid length portion of the handle 116. The end 118 of one of the arms of the handle 116 is configured to engage the mutually adjacent lever arm of the two arm lever 108. The other end 119 of the handle 116 is configured to enable an attendant to manually grip the handle to effect pivotal operation thereof about the axis of the pin 117. Thus, when the handle 116 is pivoted about the axis of the pin 117 from the position illustrated in FIG. 15 to the position illustrated in FIG. 16, the end 118 will engage the mutually adjacent end of the two arm lever 108 to cause the mid-section 109 thereof to move into engagement with the abutment 111 and to cause a pivoting of the two arm lever 108 about an axis defined by the fulcrum 111. It will be noted that the pin 113 is configured to slide within the slot 112 so that an appropriate alignment of the two arm lever 108 is maintained between the two handles 116. FIG. 17 illustrates both handles 116 having been pivoted relative to the position illustrated in FIG. 15. When the two arm lever 108 is shifted to either the position illustrated in FIG. 16 or the position illustrated in FIG. 17, one end of the Bowden cable 114 will be pulled to effect actuation of an actuator 122 yet to be described.

Figure 14:
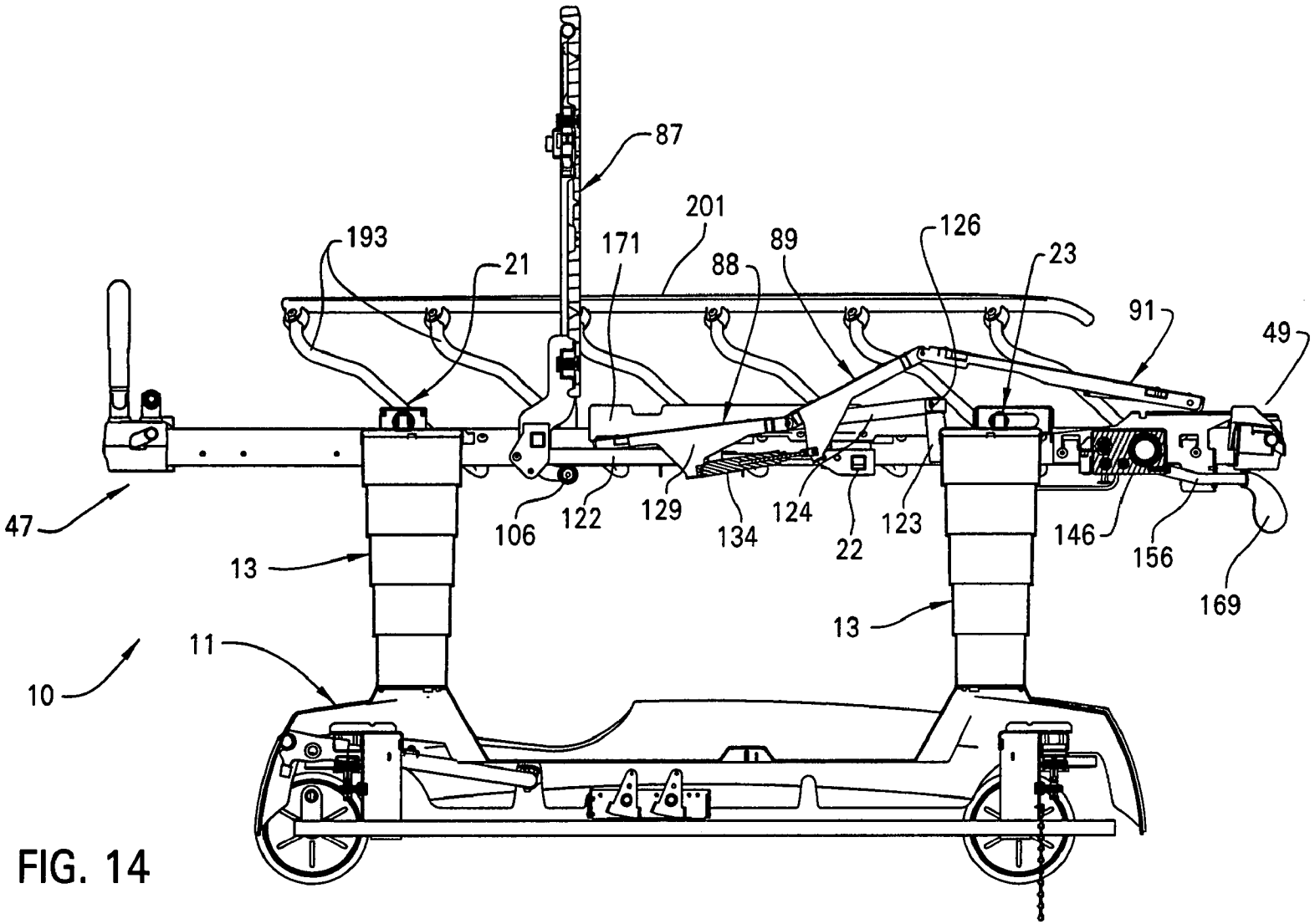
FIG. 14 is a sectional view similar to FIG. 10 but with the head section having been moved to a full upright position.

As is illustrated in FIG. 3, the lateral support rail 22 has a clevis type bracket 121 mounted thereon. An extendable and retractable actuator 122 is connected at one end to the bracket 121 and at the other end to the bracket 104 on the head section 87. In this particular embodiment, the actuator 122 is a gas spring biased to a normally extended position corresponding to the head section 87 being raised to the fully raised position as illustrated in FIG. 14. The end of the Bowden cable 114 remote from the two arm lever 108 is secured to an operative linkage on the actuator 122 to facilitate an unlocking of the actuator to facilitate extension and retraction of the extendable and retractable member of the actuator 122. The gas spring actuator 122 is of a conventional construction well known in the art and further description thereof is deemed unnecessary. When the handles 116 on the head section are in the normal inoperative position illustrated in FIG. 15, the control linkage construction on the actuator 122 will be effective for locking the extendable and retractable member of the actuator in a fixed position. Movement of one or both of the handles 116 to the pivoted positions illustrated in FIGS. 16 and 17 will effect a pulling of the Bowden cable 114 to effect a movement of the control linkage for the actuator to effect an unlocking of the extendable and retractable member to enable it to move to a further extended or retracted position to enable the head section 87 to pivot about the access of the pins 93 securing the head section 87 to the brackets 92 on the litter frame 17.

It will be noted in FIG. 1 that adjacent the thigh section 89, there is provided a pair of laterally spaced brackets 123 which are fixedly secured to the longitudinally extending support rails 18 and 19. To the brackets 123 there are secured the arms of a U-shaped frame 124 which extends toward the head end of the litter frame 17 from the brackets 123. A pin 126 effects a securement of each of the arms of the U-shaped frame 124 to the brackets 123 in order to render the frame 124 pivotal about the axis of the pins 126. The seat section 88 is fixedly mounted to the U-shaped frame 124 at a location that is mutually adjacent to the foot end of the head section 87. The seat section 88 includes a support deck member 127 which is secured to the frame 124 by a plurality of fasteners not illustrated. An underside 128 of the U-shaped frame 124 adjacent the bight section thereof is supported on the rollers 106 as illustrated in FIG. 7. If desired, the underside 128 of the support deck 127 can be fitted with a guide track in order to facilitate a guidance of the respective rollers 106 on the underside 128. The U-shaped frame 124 has an extension bracket 129 (FIG. 7) thereon which extends downwardly from the underside 128 of the support deck member 127.

The thigh section 89, which is oriented adjacent the foot end of the seat section, includes a frame 90 (FIG. 9) which is pivotally mounted to the arms of the U-shaped frame 124 by a pivot axle 131. The pivot axle 131 is oriented adjacent the foot end of the seat section 88. The thigh section 89 includes a support deck member 132 mounted on the frame 90. An extension bracket 133 (FIG. 7) extends downwardly from the underside of the support deck member 132. An extendable and retractable actuator 134 is provided and one end thereof is secured to the extension bracket 129 and the other end of it is connected to the extension bracket 133.

The foot section 91 is pivotally secured to the foot end of the thigh section 89 by a pivot axle 136. The pivot axle 136 extends through openings in the arms of a plurality of U-shaped brackets 137 secured to the head end of the foot section 91 so that a journal 138 on the foot end of the thigh section 89 can be received between the arms of the respective brackets 137 in order to render the foot section 91 and thigh section 89 pivotable with respect to one another about the axis of the axle 136. The foot end of the foot section 91 includes a pair of laterally spaced skids 139 which are slideably supported on the upper surface of the respective longitudinally extending support rails 18 and 19, particularly adjacent the foot end of the respective support rails 18 and 19. The foot section 91 also includes a support deck member 141 thereon.

The support deck members 96, 127, 132 and 141 define a mattress support surface. The mattress for the patient support apparatus 10 is not illustrated in the drawings.

Figure 13:
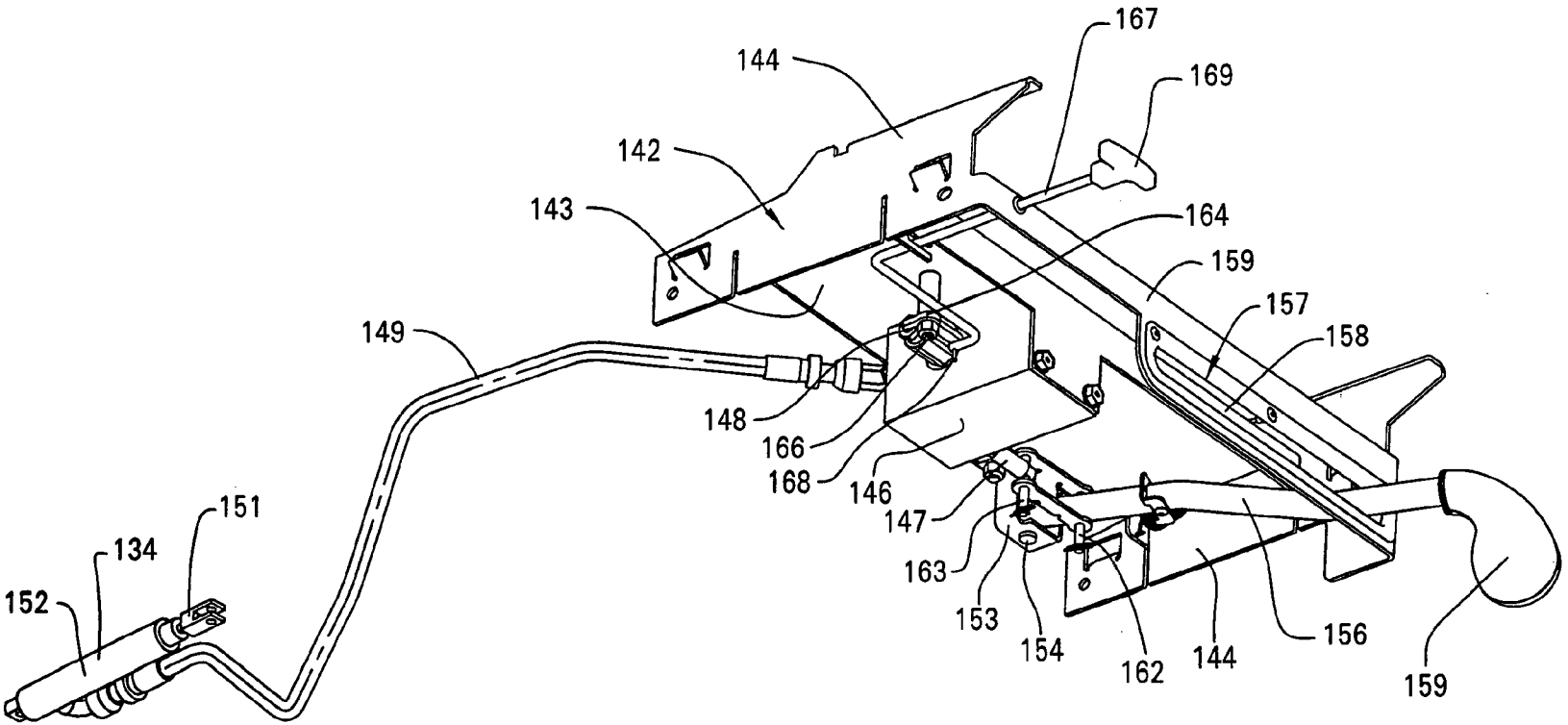
FIG. 13 is an isometric view of the hydraulic control system for a gatch control feature.

Referring to FIG. 13, there is illustrated a gatch control hydraulic circuit 140 for use in association with the actuator 134 described above. More specifically, a frame 142 is secured to the under side of the longitudinally extending side rails 18 and 19 adjacent the foot ends thereof. The frame includes a horizontally extending platform 143 and upstanding laterally spaced side walls 144 between which extends the support platform 143. A hydraulic pump body 146 is suspended from the underside of the support platform 143 intermediate the side walls 144 and includes a pair of reciprocal input members 147 and 148. The reciprocal input member 147 effects, when reciprocated into and out of the pump body 146, a pumping of hydraulic fluid through a conduit 149 to one end of the actuator 134 as illustrated in FIG. 13 to cause the extendable and retractable member 151 of the actuator 134 to extend outwardly of a body 152 thereof.

A bracket 153 is mounted to the underside of the support platform 143 and supports a pivot pin 154 whose axis is vertically oriented perpendicular to the plane of the support platform 143. A lever arm 156 is pivotally secured at one end thereof to the bracket 153 by the pin 154. The lever arm 153 extends through a laterally extending guide 157 in the form of an elongate slot 158 formed in a wall 155 joining the side walls 144 to each other along the foot end edge of the support platform 143. The end of the lever arm 156 remote from the pivot pin 154 includes a manually engageable handle member 159. A linkage member 161 is connected at one end to the pivot arm 156 by a pin 162. The other end of the linkage member 161 is connected to the reciprocal input member 147 by a pin 163. As a result, reciprocation of the pivot arm 156 between the lateral limits of the slot 158 of the guide 157 will effect a reciprocation of the reciprocal input member 147 to effect the pumping of fluid to the actuator 134 to cause the reciprocal member 151 of the actuator 134 to extend outwardly from the actuator body 152. This lateral back and forth movement of the pivot arm 156 is comfortable for the attendant to work and does not effect an application of stress to the attendant's back.

A pivot support 160 is suspended from the underside of the platform 143 on a lateral side of the housing for the pump body 146 remote from the reciprocal input member 147. A two arm lever 164 is pivotally supported at the apex thereof by a pivot pin 166 which is secured to the pivot support 160 as illustrated in FIG. 13. One end of the two arm lever 164 operatively engages the reciprocal input member 148 while the other end of the two arm lever is secured to a linkage member 167 by a pivot pin 168. The linkage member 167 is supported on the frame 142 for reciprocal movement in a direction parallel to the longitudinal axis of the support rails 18 and 19 to cause a pivotal movement of the lever arm 164 in order to effect a reciprocal movement of the reciprocal input member 148. The end of the linkage member 167 remote from the end thereof connected to the lever arm 164 is provided with a manually engageable handle 169. When a force is applied to the handle 169 pulling the linkage member 167 rightwardly in FIG. 13, the reciprocal input member 148 will be moved inwardly into the pump body 146 against a yieldable return force, such as a not illustrated spring in the pump body 146, to effect a release of the fluid pressure of the hydraulic fluid in the conduit 149 to effect a retraction of the reciprocal member 151 into the actuator body 152 of the actuator 134. If desired, a not illustrated spring can be connected to and extend between the brackets 129 and 133 to enhance the retraction function of the actuator 134. On the other hand, the actuator 134 can be provided with an internal return spring for accomplishing the same thing.

Figure 4:
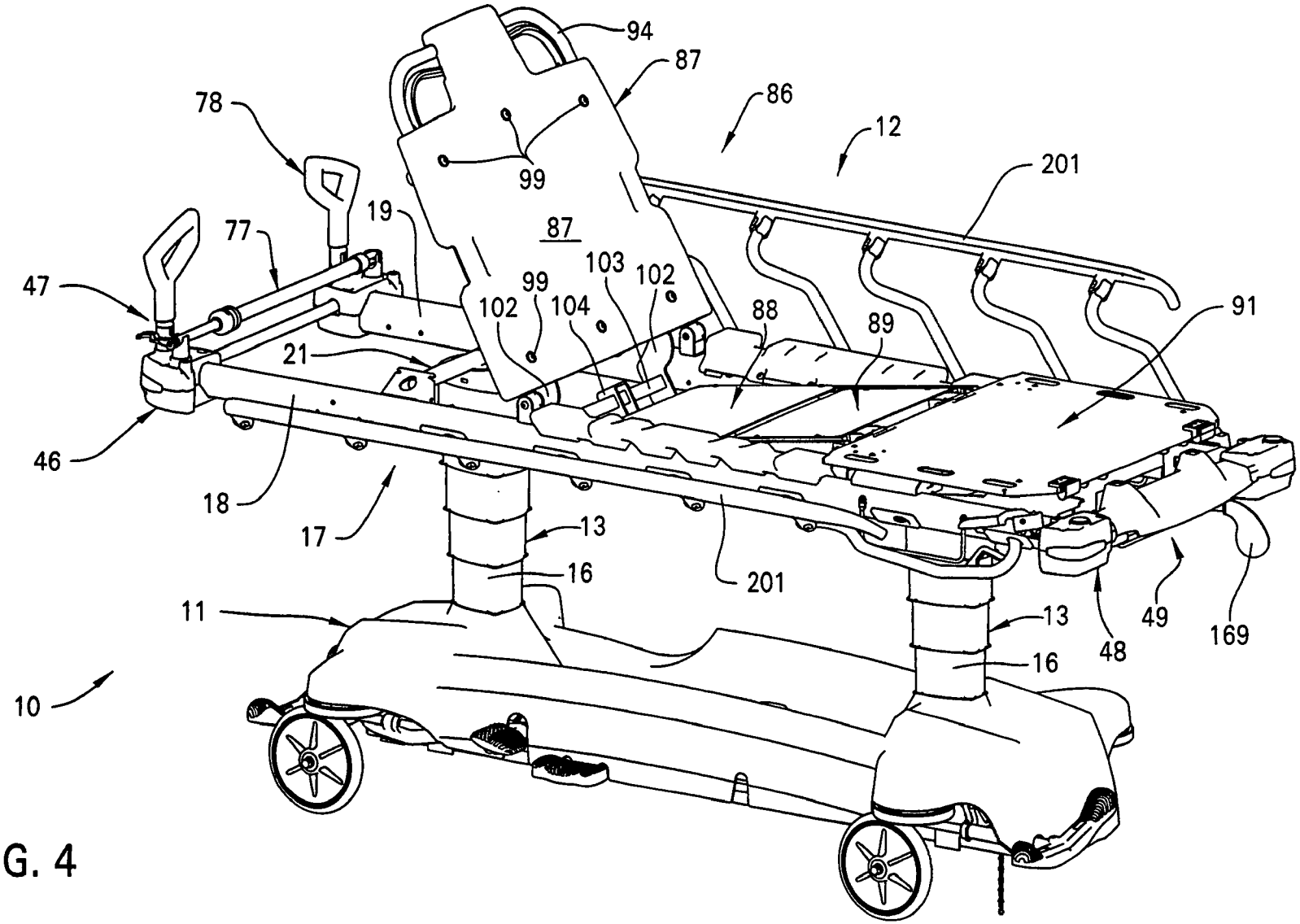
FIG. 4 is an isometric view similar to FIG. 1 but with the head, seat and thigh sections having been moved to a different position.
Figure 8:
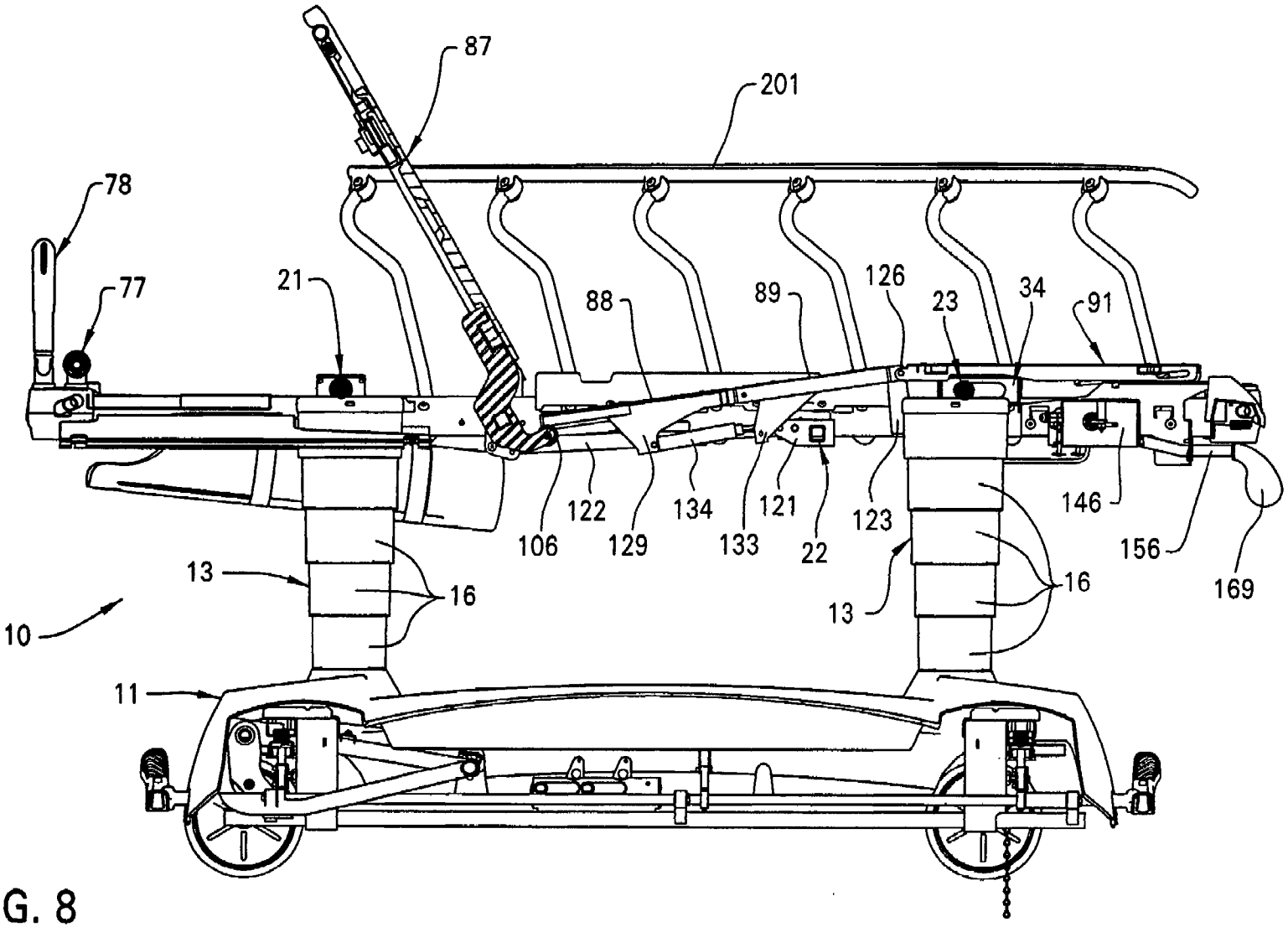
FIG. 8 is a sectional view similar to FIG. 7 but with the head, seat and thigh sections having been moved to a different position.
Figure 9:
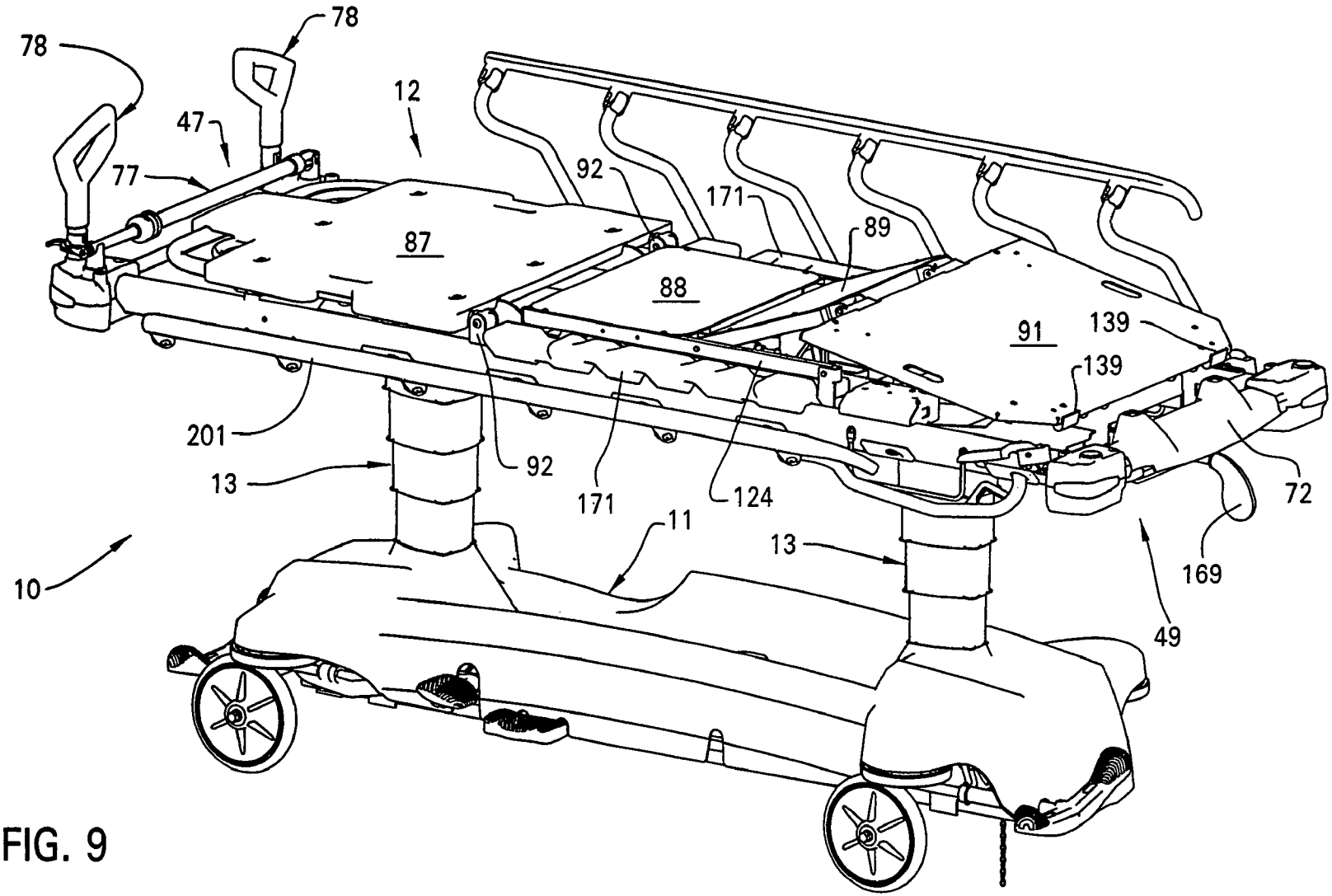
FIG. 9 is an isometric view similar to FIG. 1 except that the thigh and foot sections have been moved to a different position.
Figure 10:
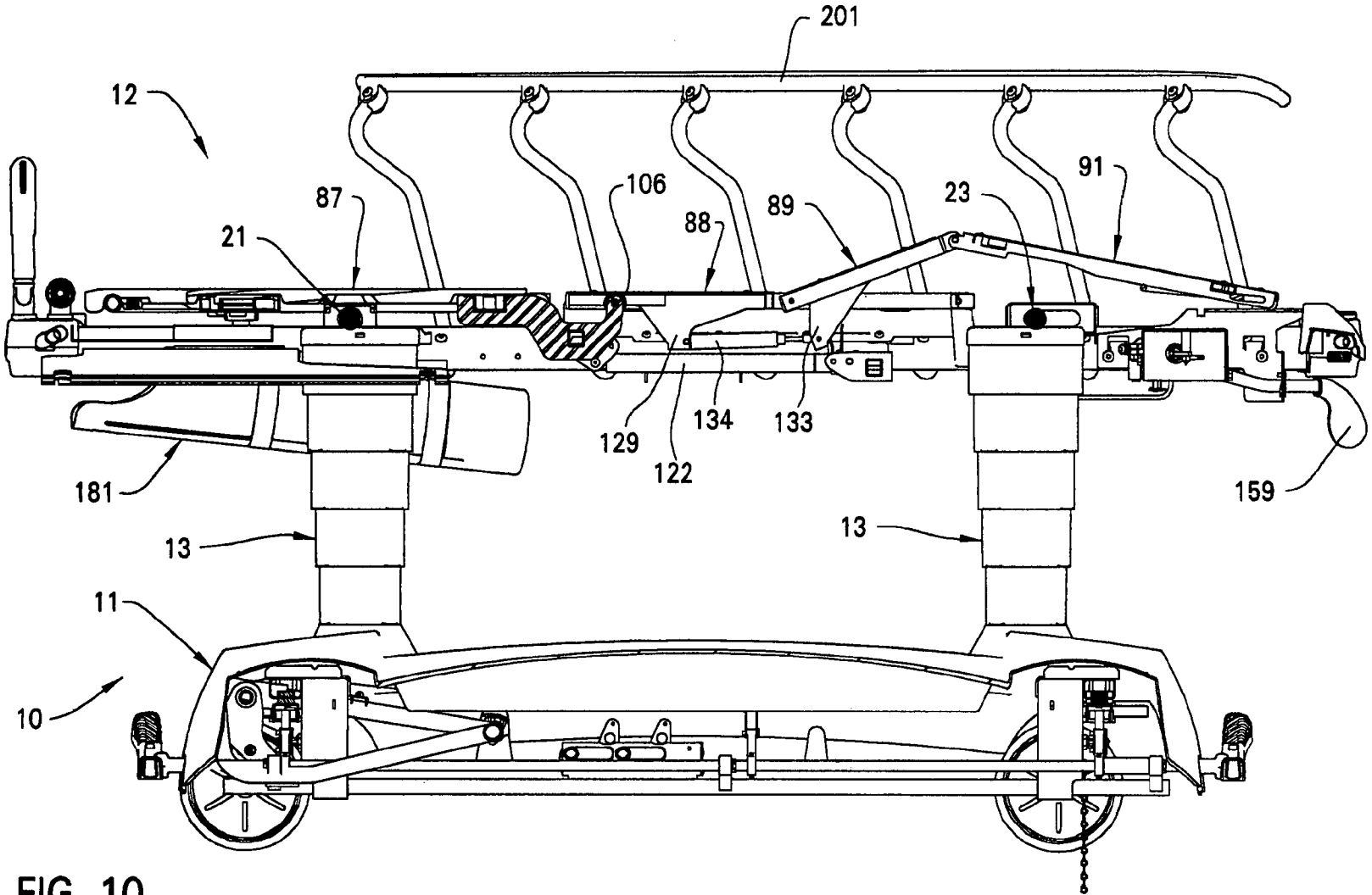
FIG. 10 is a sectional view similar to FIG. 7 but with the thigh and foot sections having been moved to a different position.
Figure 11:
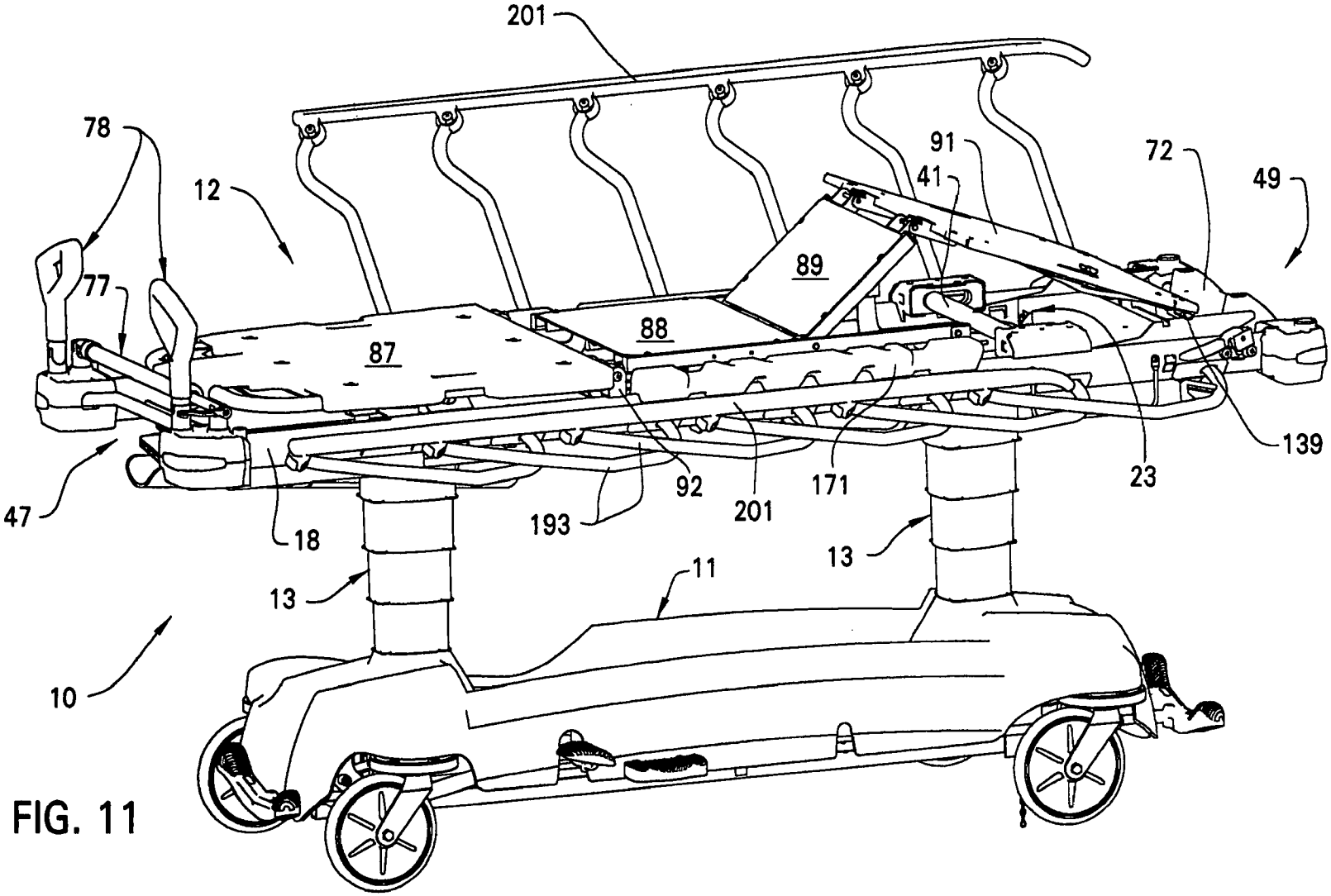
FIG. 11 is an isometric view similar to FIG. 9 except that the thigh and foot sections have been moved to a still different position.
Figure 12:
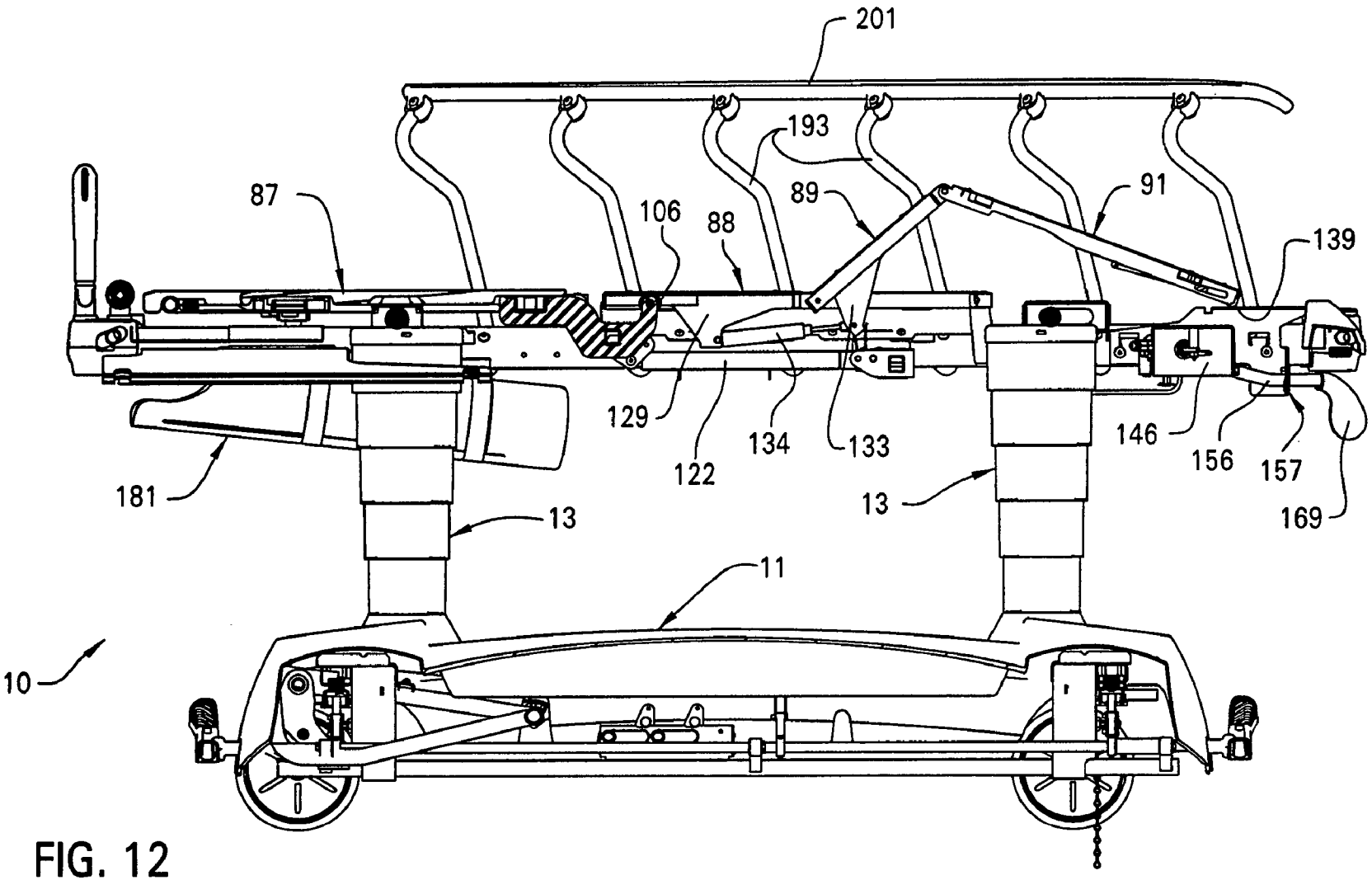
FIG. 12 is a sectional view similar to FIG. 10 but with the thigh and foot sections having been moved to the aforesaid still different position.

When the handle 159 is moved laterally back and forth and the guide 157, and the reciprocal member 151 of the actuator 134 is extended from the actuator body 152 against the urging of the not illustrated spring, the extension brackets 129 and 133 will be separated from one another to cause the thigh section 89 to be pivoted about the axle 131 from the positions illustrated in FIGS. 1 and 7 to the position illustrated in FIG. 9. When this happens, the head end of the foot section 91 will be lifted and the skids 139 will slide along the upper surfaces of the longitudinally extending support rails 18 and 19. FIGS. 11 and 12 illustrate the thigh and the foot section moved to a further elevated position relative to the litter frame 17. This form of gatch control is not impacted by a change of elevation of the head section relative to the litter frame. That is, when the head section 87 is pivoted upwardly from the FIG. 1 position to the FIG. 4 position, the rollers 106 will move downwardly from the FIG. 7 position to the FIG. 8 position causing the U-shaped frame 124 to pivot about the axle pin 126 so that both the seat section and the thigh section will be oriented at a different location inclined to the horizontal. Since the actuator 134 is secured at opposite ends thereof to the extension brackets 129 and 133, any gatch orientation of the thigh section and the foot section will be maintained even though the seat section 88 and the thigh section 89 have been dropped or pivoted about the axis of the pin 126. Furthermore, the weight of the patient on the seat section 88 and the force from the gas spring 122 will facilitate a dropping of the seat section as well as a raising of the head section 87. A pulling of the handle 169 rightwardly (FIG. 13) will cause a retraction of the actuator 134 and a return of the thigh and foot sections 89 and 91 toward the original positions thereof shown in FIGS. 1 and 4.

The seat section 88, thigh section 89 and foot section 91 can be pre-assembled and secured to the brackets 123. Similarly the hydraulic circuit 140 mounted on the frame 143 can all be pre-assembled, including the pivot arm 156 and the linkage member 167, and then be secured as a unit to the longitudinally extending support rails 18 and 19.

Figure 6:
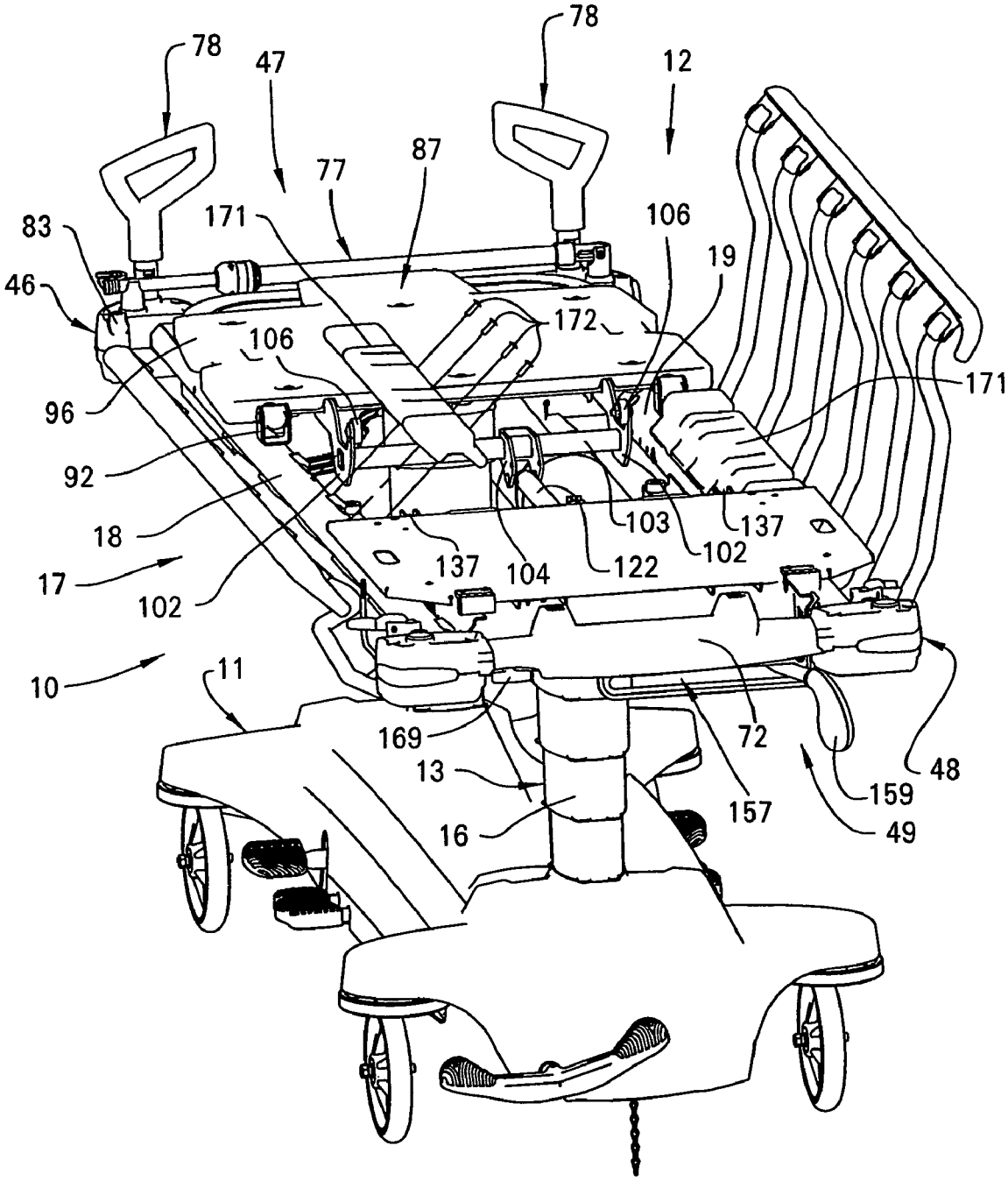
FIG. 6 is an isometric view of the patient support apparatus viewed from the foot end.
Figure 28:
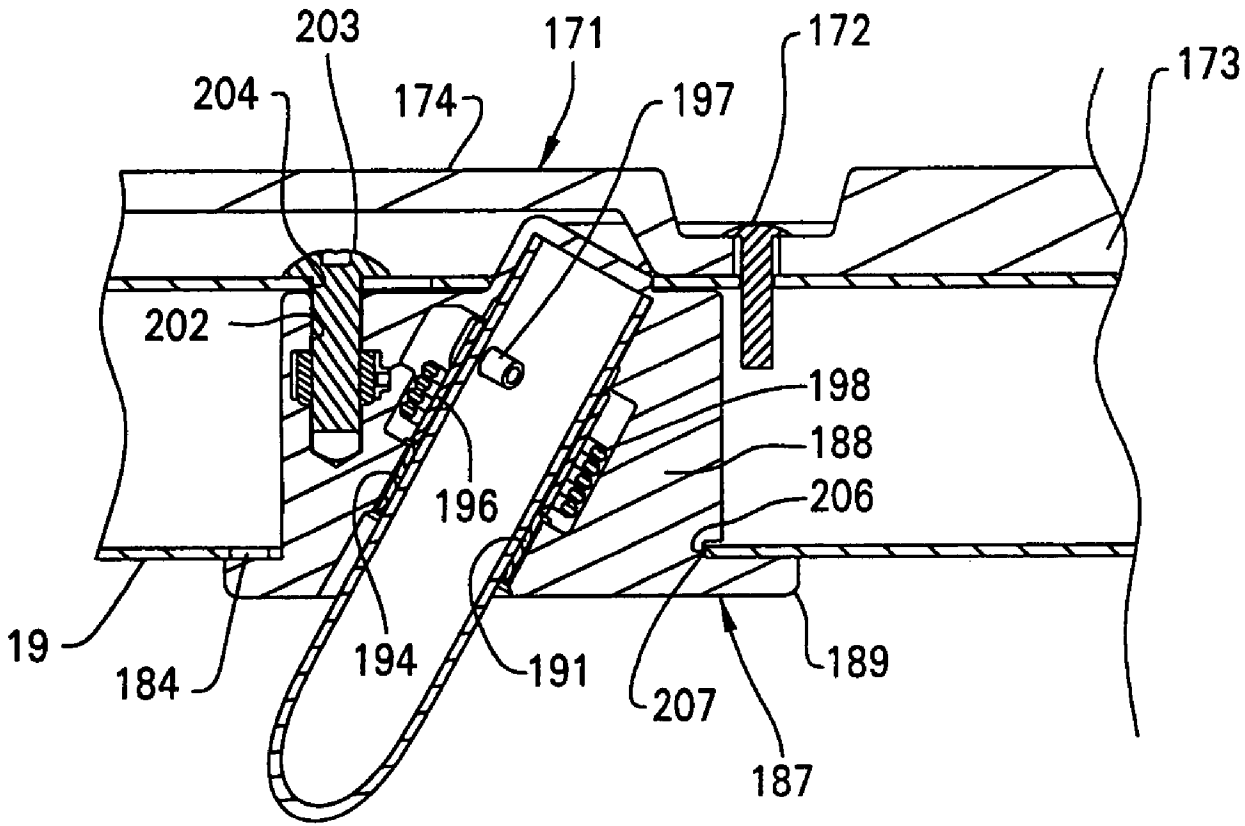
FIG. 28 is an enlarged sectional view of an installed modularized siderail assemblage.

Synthetic resin side bolsters 171 are mounted to the upper side of the longitudinally extending support rails as illustrated in FIG. 6 between the foot end of the head section 87 and the head end of the foot section 91. The bolsters 171 are secured to the longitudinal support rails 18 and 19 by a plurality of fasteners 172. The bolsters 171 are yieldable and provide a comfort zone between the foot end of the head section 87 and the head end of the foot section 91 when the patient is sitting on the seat and thigh sections 88 and 99 with the legs dangling over the edge of the patient support deck. As illustrated in FIG. 28, each bolster 171 includes a plurality of feet 173 which are spaced along the length of the bolster 171 and it is through the feet 173 that the fastener 172 effects a securement of the bolster 171 to the respective one of the side rails 18 and 19. The portion of 174 between the feet 173 is resiliently yieldable and spaced from the support rails 18 and 19 so that it can move toward and away from the outer surface of the support rails 18 and 19.

Figure 42:
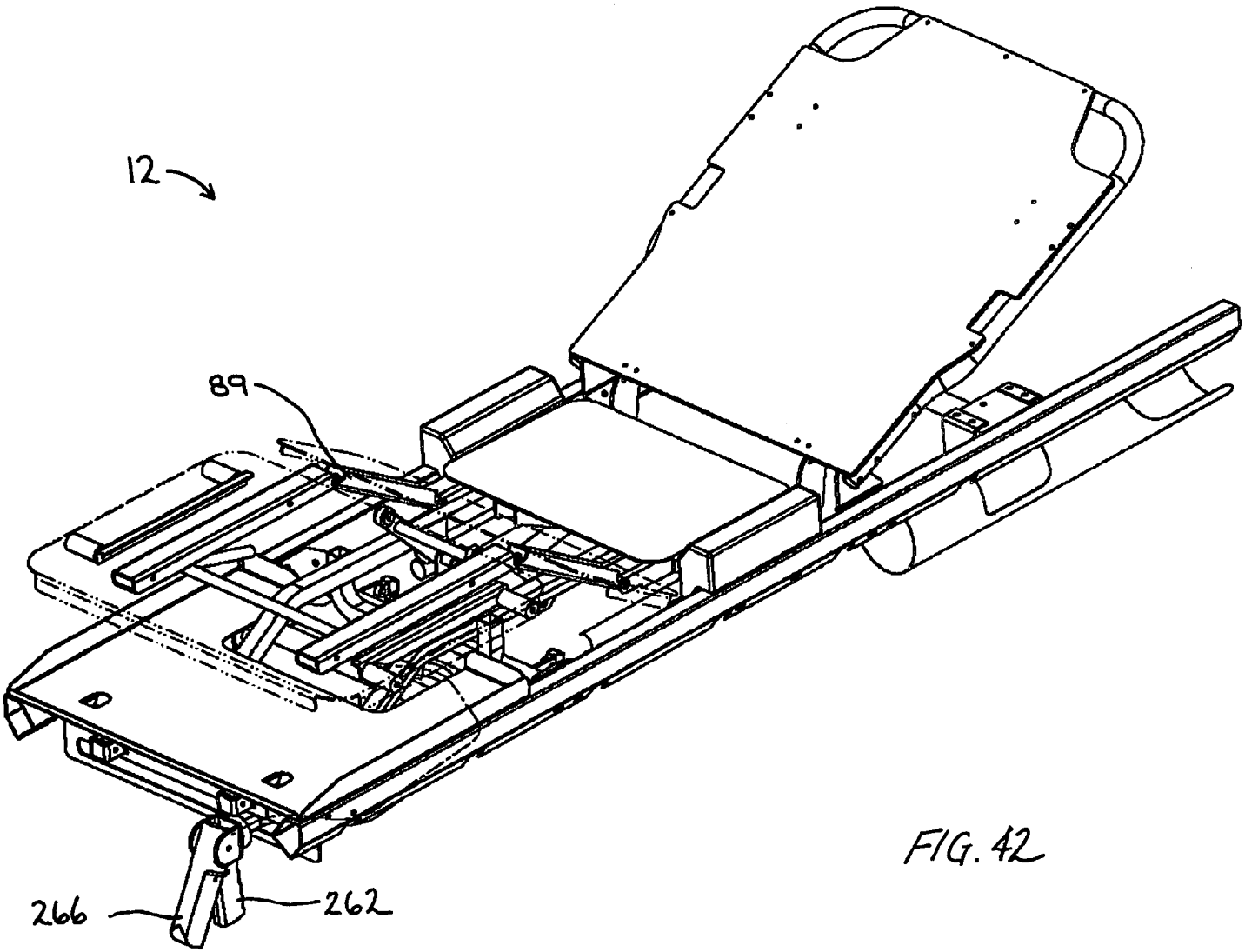
FIG. 42 is a perspective view of a patient support apparatus with an alternate embodiment of a trigger-activated gas-spring for a knee gatch according to the invention.
Figure 43:
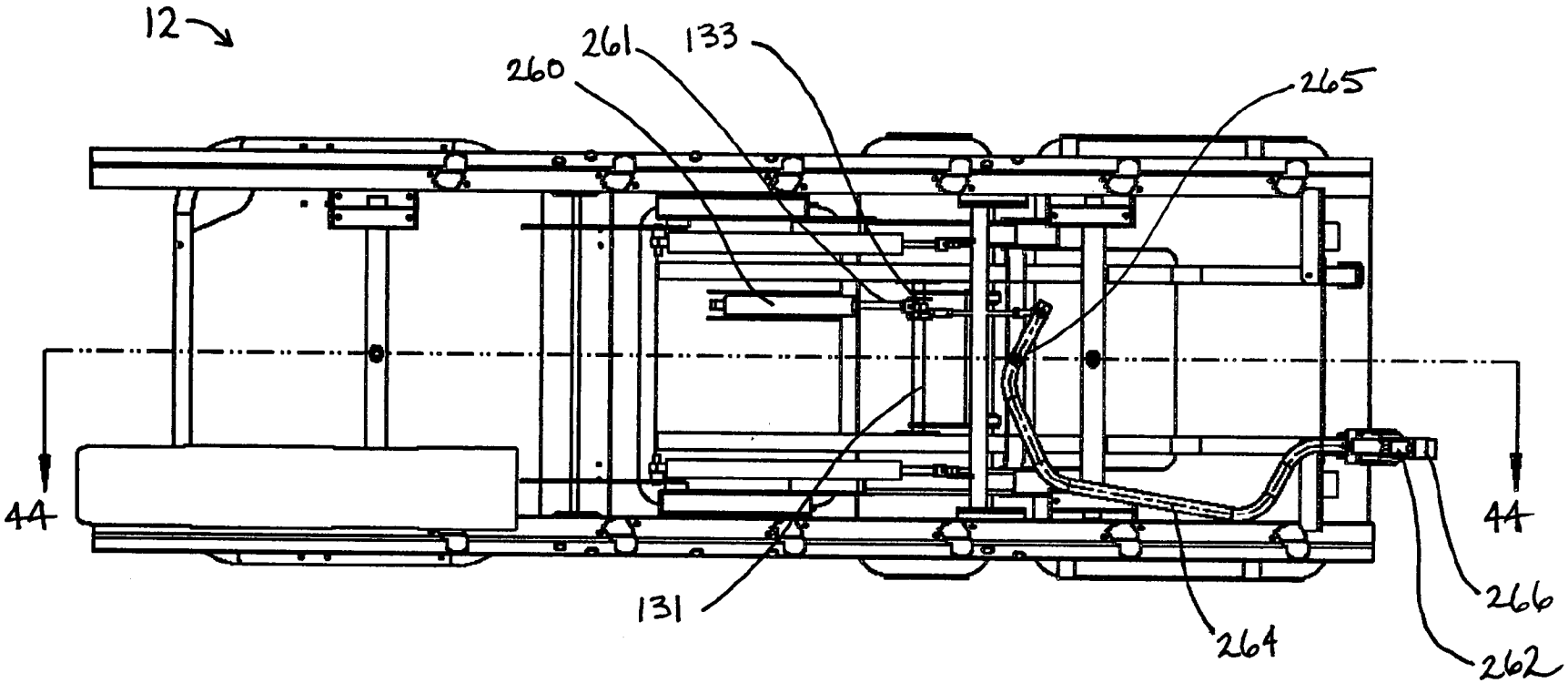
FIG. 43 is a bottom view of the patient support apparatus with trigger-activated gas-spring for a knee gatch of FIG. 42.
Figure 44:
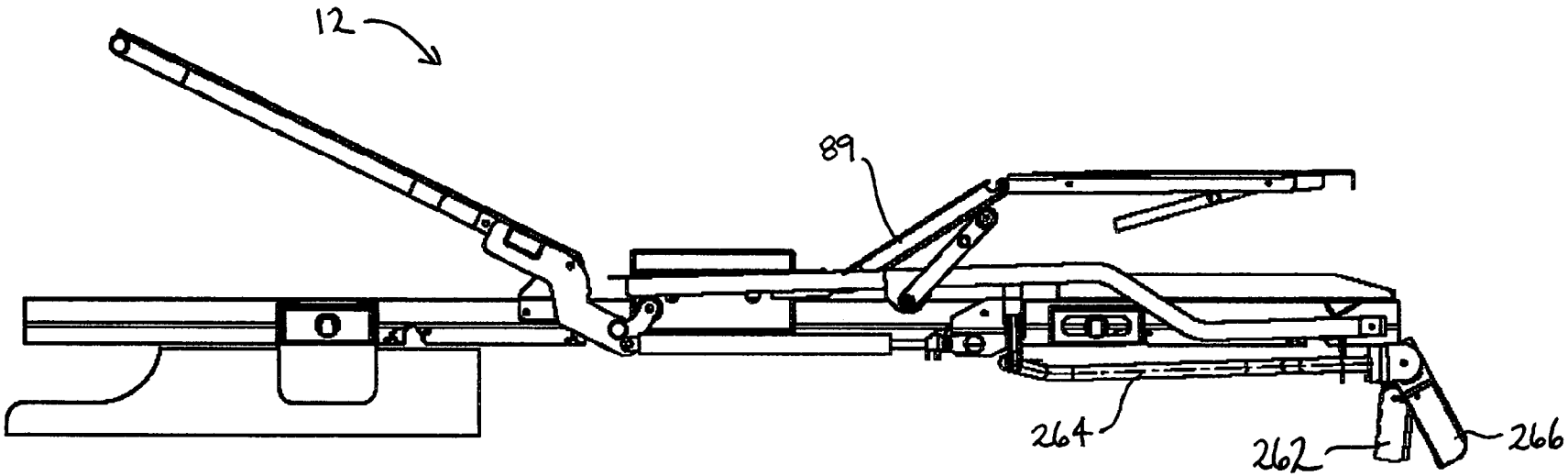
FIG. 44 is a cross-sectional view taken through line 44-44 of FIG. 43.

In an alternative embodiment, the thigh section 89 is raised by a gatch lift mechanism shown in FIGS. 42-44. The actuator 134 is replaced by a conventional locking gas spring 260 that is configured to counteract the weight resting on the thigh section 89. The gas spring 260 includes an extendable and retractable rod 261. An actuator handle 262 forms a mechanical lever 264 pivotally mounted to the litter frame at a pivot point 265 and linked to the thigh section 89 for manually raising the thigh section 89. As in the previous embodiment, the thigh section 89 includes a bracket 133 configured to rotate about the pivot axle 131 to cause a raising of the thigh section 89.

Figure 45:
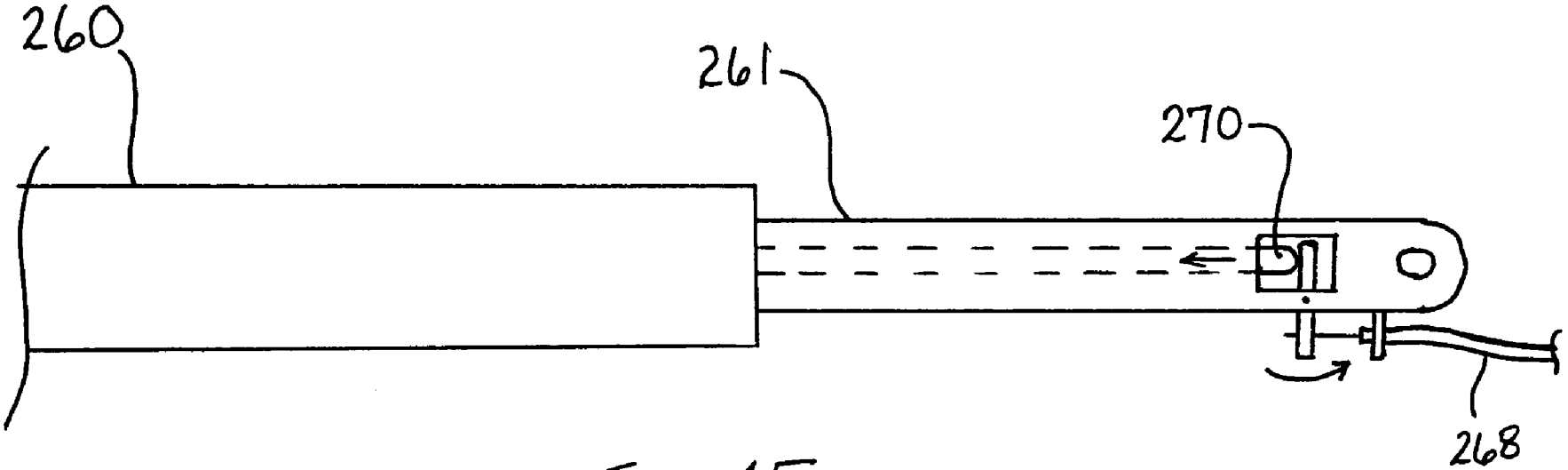
FIG. 45 is an enlarged detail view of the trigger-activated gas spring of FIGS. 42-44.

The actuator handle 262 also includes a trigger activation mechanism 266. The trigger activation mechanism 266 includes a cable 268 (FIG. 45) that is configured to operate in a conventional and well-known manner a release of a locking mechanism 270 of the gas spring 260 (as shown by the arrows in FIG. 45) so that a spring force of the gas spring 260 can operate to counteract the weight on the thigh section 89. In this manner, the gas spring 260 selectively counteracts the weight on the thigh section 89 as the attendant raises the thigh section 89 using the mechanical lever 264. Upon release of the trigger activation mechanism 266 by the attendant, the lock mechanism 270 on the gas spring 260 will return to its re-engaged condition and the thigh section 89 will become locked in position.

Figure 21:
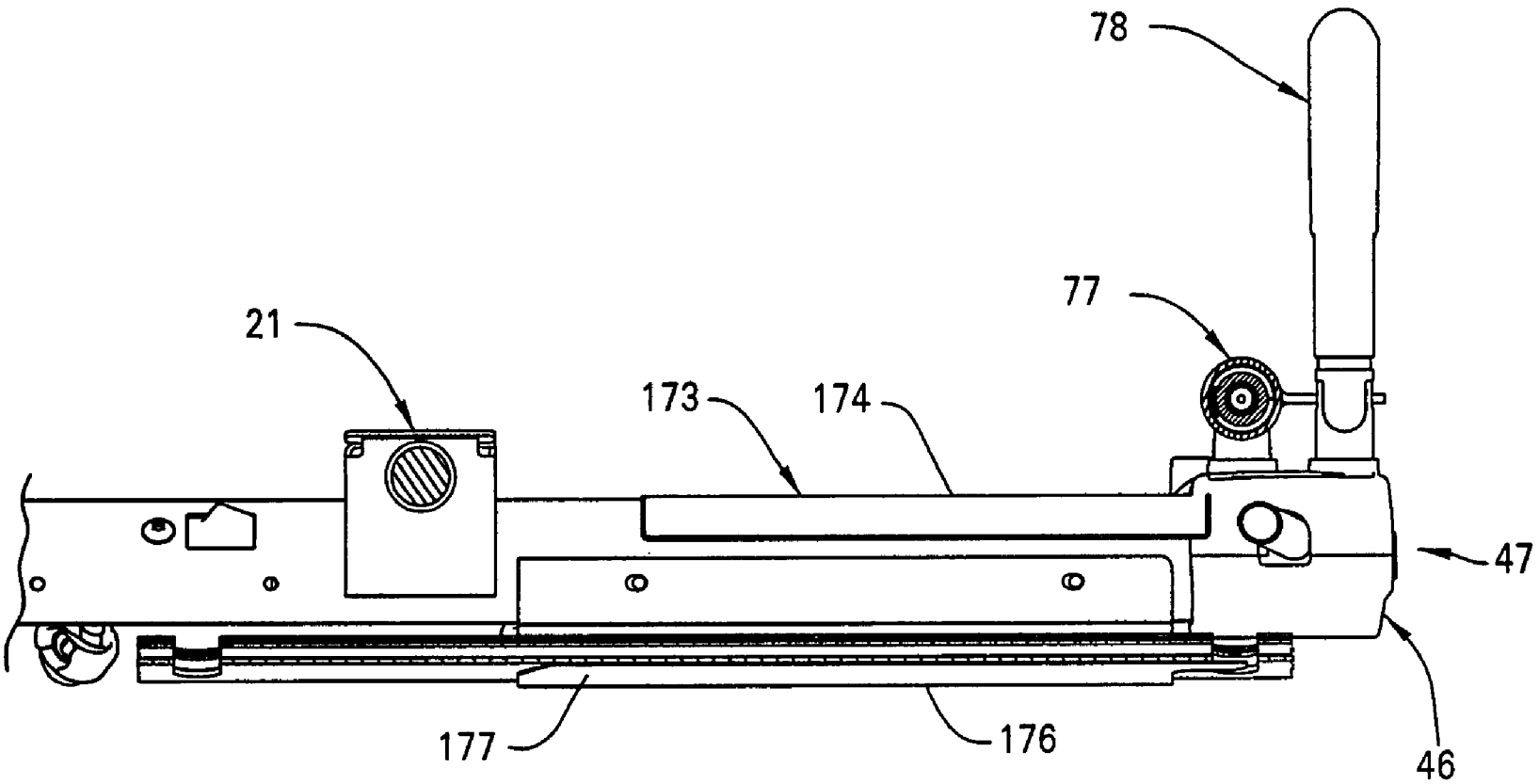
FIG. 21 is a sectional view taken along the line XXI-XXI in FIG. 20.

Referring to FIG. 20, an attendant work surface 175 is provided adjacent the head end of the support rails 18 and 19 and is oriented beneath the head section 87 when the head section is in the horizontal position illustrated in FIG. 1. When the head section 87 is elevated as is illustrated in FIG. 20, the work surface 175 becomes exposed to facilitate usage by an attendant. In this particular embodiment, the work surface 175 consists of a platform 174 that is oriented in a horizontal plane and is secured to the head end of the longitudinally extending side rails 18 and 19. As illustrated in FIG. 21, the underside of the platform 174 includes a shelf 176 onto which can be stored a patient transfer board 177. In this particular embodiment, the patient transfer board 176 is foldable. The patient transfer board additionally has a plurality of hand holes 178 therein to facilitate usage by an attendant in manipulating a patient that may be supported thereon when it is removed from the shelf, placed on top of the patient support deck under the patient's body. Since the patient transfer board 177 is made of a synthetic resin material, particularly a low friction type of a synthetic resin material, the transfer board 177 will slide easily relative to the patient support deck.

Figure 5:
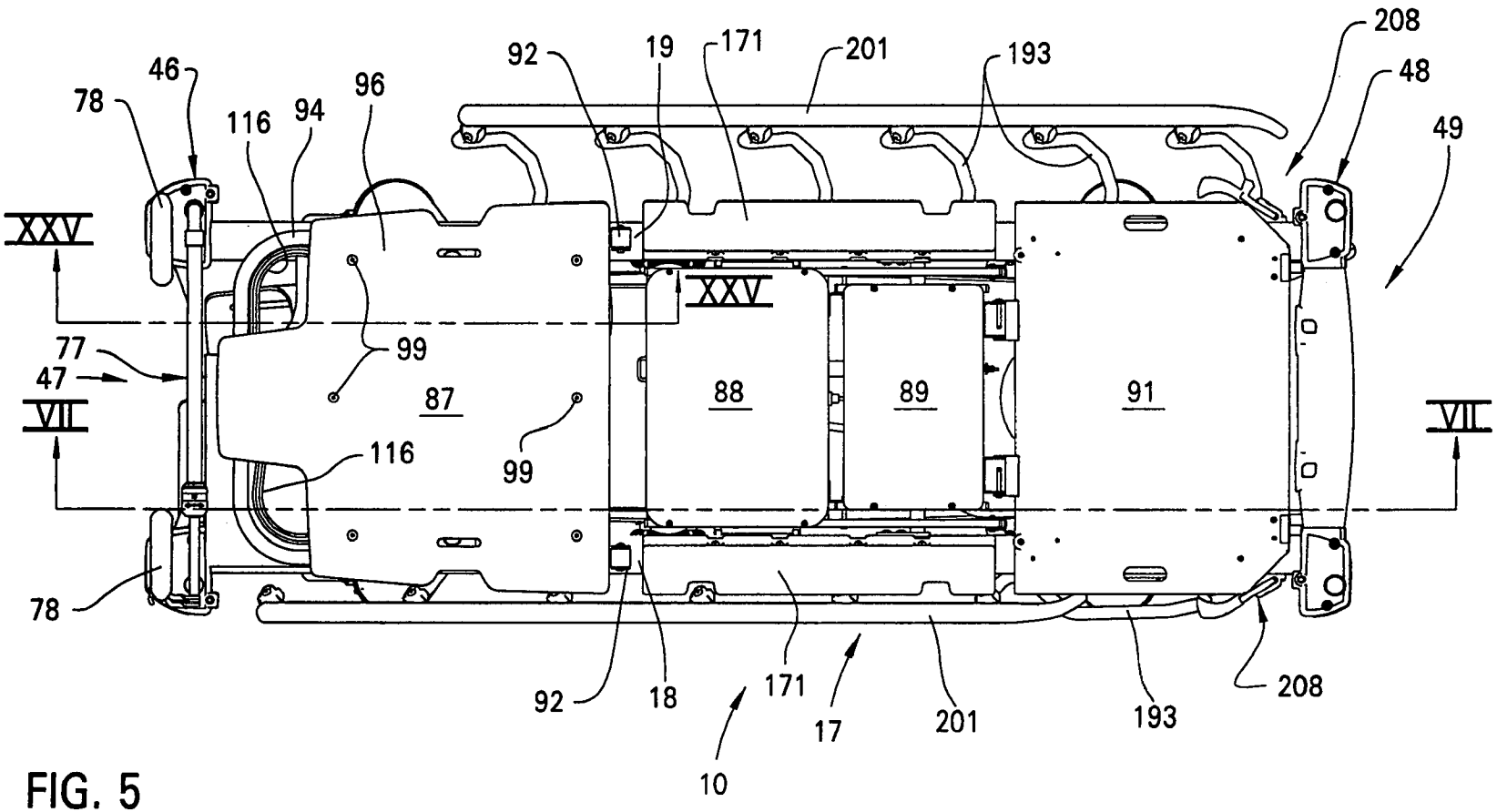
FIG. 5 is a top view of the patient support apparatus.

Intermediate the location whereat the shelf 176 is provided, a frame 179 (FIG. 5) is secured to the longitudinally extending support rail 19 and or the laterally extending support rail 21. A cylindrical shell 181 is suspended from the frame 179 so that its longitudinal axis is oriented in a vertical plane that is approximately parallel to the longitudinal axes of the support rails 18 and 19. The end 182 of the shell 181 is closed whereas the end 183 is open toward the head end 47 in order to facilitate the reception therein of a tank of bottled gas, such as a tank of oxygen. The tank of bottled gas is not illustrated in the drawings. However, it will be well understood by those skilled in this art that the valving for the tank will be located adjacent the open end 183 of the shell 181 to facilitate manipulation by an attendant.

Figure 26:
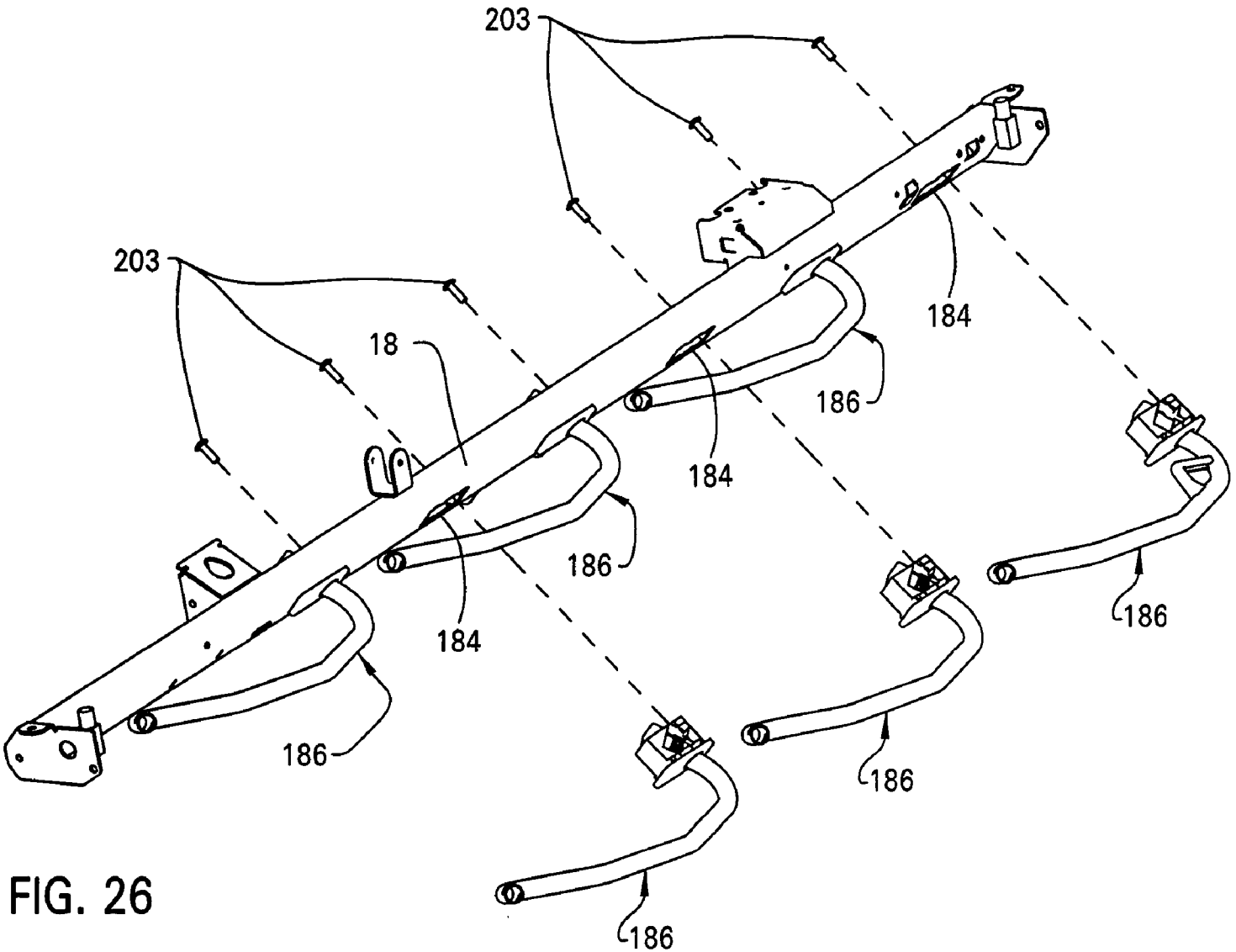
FIG. 26 is an exploded isometric view of a modularized siderail assemblage.
Figure 27:
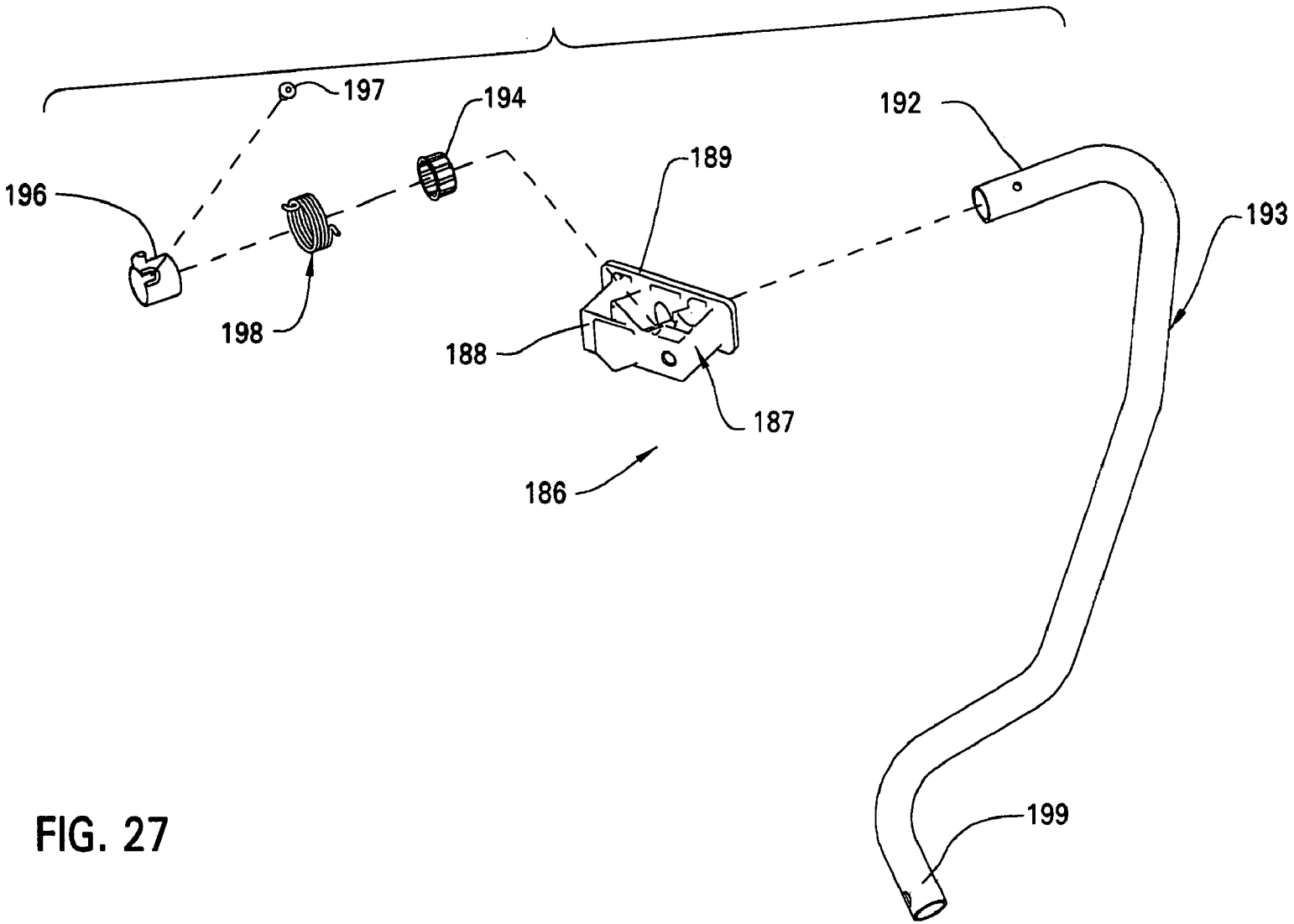
FIG. 27 is an exploded isometric view of one siderail support arm unit.

Referring to FIG. 26, each of the longitudinally extending tubular support rails 18 and 19 has a plurality of longitudinally spaced holes 184 therein opening into the interior of the hollow tubular configuration of the support rails 18 and 19. In FIG. 26, only the support rail 18 is shown, it being understood that the support rail 19 will be identical thereto but a mirror image thereof. The holes 184 are configured to receive therein a pre-assembled siderail assemblage 186. In FIG. 26, some of the siderail assemblages 186 have been inserted into the respective holes 184 while others are exploded away therefrom. FIG. 27 illustrates one of the siderail assemblages 186. Each siderail assemblage 186 includes a cartridge member 187 consisting of a synthetic resin material body member 188 having an integral peripheral flange 189 that is larger in configuration than the configuration of the respective holes 184. The body 188 of the cartridge 187 is configured to be received into each of the holes 184 to enable the flange 189 to engage the peripheral surface of the respective support rail 18 or 19. A bore 191 is provided in the body 188 of the cartridge 187 and is configured to receive one end 192 (FIG. 27) of a side rail support arm 193 and support same for rotation about the axis of rotation of the end 192. A pair of support bushings 194 and 196 and between which is a torsion spring 198 are also provided in the bore 191 and encircle the end 192. The bushing 196 is attached to the end 192 by a fastener 197. A one end of the torsion spring 198 is also secured to the aforesaid one end 192 by the fastener 197 while the other end of the torsion spring 198 is secured to the body 188 in a conventional manner. The end 199 of the siderail support arm 193 is configured to be attached to a longitudinally extending hand rail 201. The feature of pre-assembling the siderail assemblages 186 onto a cartridge 187 and then inserting the cartridge into a selected hole in the longitudinally extending siderails 18 and 19 is believed to be novel. Further, the dimension of the hole 184 is slightly wider than is the width of the body 188 so as to facilitate a longitudinal shifting of the body 188 lengthwise of and relative to the support rail 18 and 19. The body 188 includes a receptacle 202 for receiving therein a fastener 203. The wall of the support rail 18 and 19 is provided with a hole 204 which becomes axially aligned with the receptacle 202 in the body 188 only when the body 188 has been inserted into the hole 184 and then shifted lengthwise (rightwardly in FIG. 28) Until a notch 206 on the body 188 receives therein an edge portion 207 of the respective hole in the support rail 18 and 19. A single fastener 203 can be inserted into the now aligned hole 204 and receptacle 202 to facilitate a fastening of the body 188 to the respective support rail 18 and 19.

The bushing 194 has a characteristic similar to that disclosed in U.S. Pat. No. 6,253,397, the subject matter of which is incorporated herein by reference. That is, the bushing 194 has a plurality of flat sides and the material of the bushing is generally a plastic material, such as polypropylene, polyethylene, polyvinylchloride or other well known plastics. The bushing is generally thin which enables the inner flat sides of the bushing to deform and elastically expand outwardly to receive the end 192 of the side rail support arm 193 while maintaining sufficient rigidity so that the inner flat sides prevent sway or pivoting of the side rail support arms 193 as is disclosed in the aforementioned patent. A conventional latching mechanism 208 (FIG. 1) is provided for latching the siderail assemblages in an upstanding and deployed position as illustrated on the right side of the patient support apparatus illustrated in FIG. 1 and to facilitate a release of the siderail configuration to enable it to move to the stowed position as is illustrated on the left side of the patient support apparatus illustrated in FIG. 1. It will be noted in FIG. 1 that the hand rail 201 is stowed beneath the upper surface of the litter frame 17 to facilitate an attendant moving close to the edge of the litter frame to access a patient provided thereon.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A patient support apparatus, comprising:

a base;

a litter frame;

an elevation mechanism interconnecting said base and said litter frame and being configured to effect changes in elevation of said litter frame relative to said base, said elevation mechanism including a pair of longitudinally spaced and independently operable extendable and retractable actuators;

and a telescoping shroud covering at least one of said actuators, the telescoping shroud including a plurality of shroud segments, the shroud segments being graduated in size for nesting, an uppermost shroud segment including a plurality of biased catches for engaging an upper mount plate attached to the litter frame, a lowermost shroud segment including a plurality of attachment elements for engaging the base, and intermediate shroud segments including an inwardly directed lip at one of an upper and a lower end and an outwardly directed lip at the other of the upper and lower end for engaging the inwardly directed lip of an adjacent shroud segment, the uppermost and lowermost shroud segments including one of the inwardly and outwardly directed lips for engaging an adjacent shroud segment.

2. The patient support apparatus of claim 1, further comprising the intermediate shroud segments including outwardly extending tabs to aid proper stacking by preventing a shroud segment from remaining in place as the elevation mechanism is lowered.

3. A patient support apparatus, comprising:

a base;

a litter frame;

an elevation mechanism interconnecting said base and said litter frame and being configured to effect changes in elevation of said litter frame relative to said base;

said litter frame having a head end and a foot end, said litter frame including a pair of laterally spaced, longitudinally extending support rails and plural laterally extending support rails interconnecting said longitudinally extending support rails, said laterally extending support rails being mounted to said elevation mechanism;

a support deck mounted on said litter frame and comprising at least a thigh section, the thigh section being pivotally mounted to the litter frame and configured for movement between a lowered and a raised position;

a gas spring mounted on said litter frame and connected between said litter frame and a portion of said thigh section;

a gatch control mechanism for raising and lowering the thigh section, the gatch control mechanism including a trigger-activation handle connected to said gas spring for locking and releasing said gas spring, and an actuation handle pivotally connected to said litter frame and connected to said portion of said thigh section for raising and lowering said thigh section.

4. The patient support apparatus of claim 3, wherein the gas spring is extendable and retractable, said gas spring including a selective locking mechanism-for locking said gas spring at selected extended and retracted positions.

5. The patient support apparatus of claim 4, wherein said trigger-activation handle is connected to said selective locking mechanism on said gas spring and said actuation handle is pivotally connected to said litter frame and connected to said portion of said thigh section for effecting a manual raising and lowering of said thigh section assisted by extension and retraction of said gas spring.

6. A patient support apparatus, comprising:

a base;

a litter frame;

an actuator connected to said base and said litter frame, said actuator configured to effect changes in elevation of said litter frame relative to said base;

a telescoping shroud covering said actuator, the telescoping shroud including a plurality of shroud segments, the shroud segments being graduated in size for nesting;

an uppermost shroud segment adapted to attach to the litter frame, said uppermost shroud segment including one of an inwardly and outwardly directed lip at a bottom end of said uppermost shroud segment;

a lowermost shroud segment adapted to attach to the base, said lowermost shroud including one of an inwardly and outwardly directed lip at a top end of said lowermost shroud segment; and at least one intermediate shroud segment, said at least one intermediate shroud segment including an inwardly directed lip at one of an upper and a lower end and an outwardly directed lip at the other of the upper and lower end, said outwardly directed lip of said at least one intermediate shroud segment adapted to engage an inwardly directed lip of a first adjacent shroud segment, and said inwardly directed lip of said at least one intermediate shroud segment adapted to engage an outwardly directed lip of a second adjacent shroud segment.

7. The patient support apparatus of claim 6 wherein said at least one intermediate shroud segment further includes an outwardly extending tab adapted to prevent a shroud segment from remaining in place as the actuator is lowered.

8. The patient support apparatus of claim 6 wherein said lowermost shroud segment and said at least one intermediate shroud segment are both sized to nest within said uppermost shroud segment when said litter frame is lowered to said base.

9. The patient support apparatus of claim 6 wherein said uppermost shroud segment includes a plurality of biased catches for engaging an upper mount plate attached to the litter frame.

10. The patient support apparatus of claim 9 wherein said lowermost shroud segment includes a plurality of attachment elements for engaging the base.

11. The patient support apparatus of claim 8 wherein said patient support apparatus includes at least three of said intermediate shroud segments.

12. The patient support apparatus of claim 6 wherein said patient support apparatus includes a plurality of said actuators and a plurality of said telescoping shrouds.

13. A patient support apparatus, comprising:

a base;

a litter frame;

an elevation mechanism interconnecting said base and said litter frame and being configured to effect changes in elevation of said litter frame relative to said base;

a support deck mounted on said litter frame and comprising at least a thigh section, the thigh section being pivotally mounted to the litter frame and configured for movement between a lowered and a raised position;

a gas spring mounted on said litter frame and connected between said litter frame and a portion of said thigh section;

a gatch control adapted to raise and lower the thigh section, the gatch control including a trigger connected to said gas spring for locking and releasing said gas spring, and an actuation handle pivotally connected to said litter frame and connected to said portion of said thigh section for raising and lowering said thigh section.

14. The patient support apparatus of claim 13 wherein the gas spring is moveable between extended and retracted positions, and said gas spring includes a lock adapted to lock said gas spring at selected extended and retracted positions.

15. The patient support apparatus of claim 14 wherein said trigger is connected to said lock on said gas spring, and said actuation handle is pivotally connected to said litter frame and to said portion of said thigh section for effecting a manual raising and lowering of said thigh section assisted by extension and retraction of said gas spring.

16. The patient support apparatus of claim 14 further including a telescoping shroud covering said elevation mechanism, the telescoping shroud including a plurality of shroud segments, the shroud segments being graduated in size for nesting within each other.

17. The patient support apparatus of claim 16 wherein said plurality of shroud segments includes:

an uppermost shroud segment adapted to attach to the litter frame, said uppermost shroud segment including one of an inwardly and outwardly directed lip at a bottom end of said uppermost shroud segment;

a lowermost shroud segment adapted to attach to the base, said lowermost shroud including one of an inwardly and outwardly directed lip at a top end of said lowermost shroud segment; and at least one intermediate shroud segment, said at least one intermediate shroud segment including an inwardly directed lip at one of an upper end and a lower end and an outwardly directed lip at the other of the upper end and lower end, said outwardly directed lip of said at least one intermediate shroud segment adapted to engage an inwardly directed lip of a first adjacent shroud segment, and said inwardly directed lip of said at least one intermediate shroud segment adapted to engage an outwardly directed lip of a second adjacent shroud segment.

* * * * *